US010123634B2

(12) United States Patent
Volz et al.

(10) Patent No.: US 10,123,634 B2
(45) Date of Patent: Nov. 13, 2018

(54) DISPLAY UNIT CONFIGURED FOR QUICK ASSEMBLY

(71) Applicant: InnerWorkings, Inc., Chicago, IL (US)

(72) Inventors: Jodi Volz, Loveland, OH (US); Aaron Rieke, Cincinnati, OH (US)

(73) Assignee: INNERWORKINGS, INC., Chicago, IL (US)

( * ) Notice: Subject to any disclaimer, the term of this patent is extended or adjusted under 35 U.S.C. 154(b) by 0 days.

(21) Appl. No.: 15/078,922

(22) Filed: Mar. 23, 2016

(65) Prior Publication Data

US 2016/0198870 A1 Jul. 14, 2016

Related U.S. Application Data

(63) Continuation-in-part of application No. 14/694,872, filed on Apr. 23, 2015.

(Continued)

(51) Int. Cl.

| | |
|---|---|
| ***A47F 5/11*** | (2006.01) |
| ***A47F 5/10*** | (2006.01) |
| ***G09F 3/00*** | (2006.01) |

(52) U.S. Cl.

CPC ..... *A47F 5/116* (2013.01); *A47F 5/10* (2013.01); *A47F 5/11* (2013.01); *G09F 3/0297* (2013.01); *A47F 5/118* (2013.01)

(58) Field of Classification Search

CPC ..... A47F 5/118; A47F 5/116; A47F 5/0043; A47F 5/112; A47F 5/114; A47F 5/11; A47F 5/0025; A47F 5/10; A47F 5/108; A47F 5/00; A47F 5/0018; A47F 5/101; A47B 43/02; A47B 47/06; A47B 55/06; A47B 61/06; A47B 47/00; A47B 47/0066;

(Continued)

(56) References Cited

U.S. PATENT DOCUMENTS

| | | | | |
|---|---|---|---|---|
| D127,916 | S | 6/1941 | Whitefield | |
| 2,738,542 | A | 4/1952 | Clark | |
| 2,961,250 | A | 7/1957 | Beach | |
| 2,850,825 | A * | 9/1958 | Grants | G09F 19/14 40/453 |

(Continued)

OTHER PUBLICATIONS

Jodi Volz, Notice of Allowance, U.S. Appl. No. 29/488,840, dated Apr. 1, 2015, 7 pgs.

(Continued)

*Primary Examiner* — Hiwot E Tefera

(74) *Attorney, Agent, or Firm* — Morgan, Lewis & Bockius LLP

(57) ABSTRACT

Disclosed herein is a display unit that is rugged, re-usable, and configured for quick (and tool-free) assembly. The display unit may be used as a specialty display in a retail store for a limited-time marketing campaign. The display unit includes a foldable frame having a plurality of vertical panels joined at vertical fold lines, with display graphics and a scannable display code for retail activation. The foldable frame is also is configured to support at least one shelf. In some embodiments, the foldable frame of the display unit is pre-adhered (e.g., a first side panel and a second side panel are adhered along respective vertical fold lines to a back panel) and desired shelf heights for the display unit are pre-configured before shipment of the display unit to a merchant. In this way, the display unit can be quickly constructed by the merchant with the desired shelf heights.

22 Claims, 21 Drawing Sheets

Related U.S. Application Data

(60) Provisional application No. 61/983,421, filed on Apr. 23, 2014.

(58) Field of Classification Search
CPC ..... A47B 47/0075; G06Q 10/08; B65G 1/00; G09F 3/0297
USPC ..... 211/135, 186, 149, 72, 126.16, 132.1; 705/28; 700/213, 214
See application file for complete search history.

(56) References Cited

U.S. PATENT DOCUMENTS 3,208,768 A 9/1965 Hulbert
4,056,295 A 11/1977 Downing
4,082,389 A * 4/1978 Stewart ..... A47B 47/042 312/258
D251,224 S 3/1979 Messenger
4,151,803 A 5/1979 Ferrera et al.
D253,023 S 10/1979 Denhoff
D253,465 S 11/1979 Lobdell
4,228,904 A * 10/1980 Dumond ..... A47F 5/112 211/55
D257,823 S 1/1981 Maza et al.
D263,820 S 4/1982 Levenberg
4,519,319 A * 5/1985 Howlett ..... A47F 5/116 108/180
4,720,115 A 1/1988 Rehrig
D294,775 S 3/1988 Rechberg
D296,737 S 7/1988 Bezzerides et al.
D300,491 S 4/1989 Grossman
4,822,066 A 4/1989 Rehrig
5,020,669 A * 6/1991 Nakagoshi ..... B65D 71/10 206/459.5
D321,965 S 11/1991 Delmerico et al.
D333,899 S 3/1993 Caceres
D335,374 S 5/1993 Schulze et al.
D340,562 S 10/1993 Kean et al.
D344,419 S 2/1994 Stoddard
D349,384 S 8/1994 Crinion
D352,586 S 11/1994 Baucom
D356,412 S 3/1995 Hensley, Jr.
D361,454 S 8/1995 Compton et al.
5,451,068 A 9/1995 Shockley
5,472,219 A 12/1995 Eckstrum
D366,745 S 1/1996 Kern et al.
5,577,744 A 11/1996 Parks
D384,466 S 9/1997 Taylor
D399,648 S 10/1998 Hilton
D404,236 S 1/1999 Bergwall
5,863,053 A 1/1999 Berry
D410,577 S 6/1999 Ciphers
6,023,866 A * 2/2000 Polsky ..... G09F 19/14 40/453
D426,987 S 6/2000 Lewis
D427,406 S 6/2000 Hartwall
6,126,022 A * 10/2000 Merkel ..... A47B 47/042 108/180
6,257,152 B1 7/2001 Liu
6,398,234 B1 6/2002 Brown
D472,358 S 3/2003 Beese, Jr.
6,570,492 B1 * 5/2003 Peratoner ..... G06F 3/147 340/12.3
6,752,280 B2 * 6/2004 Dye ..... A47F 5/116 108/162
D501,591 S 2/2005 Lucht
D503,838 S 2/2005 Archambault
6,886,787 B2 5/2005 Stahl
6,979,005 B1 12/2005 McLerran
D523,201 S 6/2006 Widmer
D532,238 S 11/2006 Thrush
7,197,991 B1 * 4/2007 Grigsby, Jr. ..... A47B 43/02 108/165
D547,517 S 7/2007 Hernandez
D549,920 S 8/2007 Dukes
7,273,149 B2 * 9/2007 Lutes ..... B65D 5/5246 206/736
D560,402 S 1/2008 Lev
D573,324 S 7/2008 Hernandez
D580,193 S 11/2008 Sparkowski
7,481,438 B2 1/2009 Hernandez
D591,531 S 5/2009 Sparkowski
D594,622 S 6/2009 Kissun
D608,115 S 1/2010 Trinh et al.
D610,323 S 2/2010 Saladino
D611,219 S 3/2010 Banasik et al.
D614,888 S 5/2010 Sexton
D614,899 S 5/2010 Lai
D619,844 S 7/2010 Johnson
D620,669 S 7/2010 Hernandez
7,793,485 B2 * 9/2010 Blocker ..... B65D 77/02 206/459.5
D626,237 S 10/2010 Nordgren et al.
D635,801 S 4/2011 Stubis
D644,039 S 8/2011 Naples et al.
D644,452 S 9/2011 Naples et al.
D650,545 S 12/2011 Malone et al.
D653,893 S 2/2012 Huss et al.
D654,748 S 2/2012 Lu
8,109,391 B2 * 2/2012 Susnjara ..... G06Q 90/00 209/3.3
D657,591 S 4/2012 Sanchez
D660,052 S 5/2012 Flores
D679,466 S 4/2013 McCullough
D689,715 S 9/2013 Wong
8,544,859 B2 10/2013 Itmec et al.
D693,159 S 11/2013 Lidwell et al.
8,602,443 B2 12/2013 Moore et al.
8,651,298 B2 2/2014 Beaty
8,695,878 B2 * 4/2014 Burnside ..... G06Q 10/087 235/385
D703,975 S 5/2014 Huss et al.
D707,914 S 6/2014 Ward
D716,080 S 10/2014 Bell et al.
D718,077 S 11/2014 Schneider, Jr. et al.
D722,243 S 2/2015 Kehoe et al.
9,004,300 B1 4/2015 Morrell
D731,823 S 6/2015 Kelinske et al.
D732,817 S 6/2015 Elstow et al.
D733,386 S 6/2015 Della Polla
D734,413 S 7/2015 Bettin et al.
D735,510 S 8/2015 Volz
D735,833 S 8/2015 Winstead
D739,886 S 9/2015 Vetter
D740,591 S 10/2015 Huss et al.
D741,629 S 10/2015 Meissner et al.
D747,901 S 1/2016 Kanagy et al.
D748,416 S 2/2016 Meissner et al.
D752,372 S 3/2016 Huff et al.
D754,458 S 4/2016 Mason
D775,871 S 1/2017 Volz et al.
D784,052 S 4/2017 Rodriguez
2002/0008048 A1 * 1/2002 Ishikawa ..... B65D 19/385 206/600
2003/0121872 A1 * 7/2003 Gervasi ..... A47F 5/0018 211/149
2003/0205877 A1 11/2003 Verna et al.
2005/0086910 A1 * 4/2005 Chambers ..... B65D 21/0205 53/399
2005/0151336 A1 7/2005 Neuman
2005/0212242 A1 9/2005 Cheng
2006/0207481 A1 * 9/2006 McCarthy ..... B65D 19/0026 108/51.3
2007/0000857 A1 * 1/2007 Roth ..... A47B 43/02 211/195
2007/0296167 A1 12/2007 Beswick et al.
2009/0134230 A1 * 5/2009 Stojak ..... B65D 65/10 235/494
2009/0234668 A1 * 9/2009 Wheeler ..... G06Q 10/087 705/346
2010/0030667 A1 * 2/2010 Chudy ..... G06F 19/3462 705/28

(56) References Cited

U.S. PATENT DOCUMENTS

| | | | | |
|---|---|---|---|---|
| 2010/0133128 | A1* | 6/2010 | Preece | B65D 5/4229 206/232 |
| 2010/0133215 | A1* | 6/2010 | Norman | A47B 87/0261 211/85.8 |
| 2011/0156367 | A1 | 6/2011 | King | |
| 2012/0132569 | A1* | 5/2012 | Susnjara | G06Q 10/08 209/3.3 |
| 2013/0062293 | A1* | 3/2013 | Beaty | A47F 5/11 211/59.2 |
| 2014/0008884 | A1 | 1/2014 | Itmec et al. | |
| 2014/0110481 | A1* | 4/2014 | Burnside | G06Q 10/087 235/385 |
| 2014/0116908 | A1* | 5/2014 | Beyer | B65D 1/00 206/449 |
| 2014/0229000 | A1* | 8/2014 | Hoshino | B65G 1/1378 700/215 |
| 2014/0230295 | A1 | 8/2014 | Hawkins | |
| 2015/0157145 | A1* | 6/2015 | Bussi | A47F 7/146 40/124.06 |

OTHER PUBLICATIONS

Jodi Volz, Office Action, U.S. Appl. No. 29/488,840, dated Sep. 12, 2014, 5 pgs.
Jodi Volz, Office Action, U.S. Appl. No. 29/488,838, dated Aug. 3, 2015, 5 pgs.
Jodi Volz, Office Action, U.S. Appl. No. 29/488,838, dated Feb. 9, 2016, 6 pgs.
Jodi Volz, Office Action, U.S. Appl. No. 29/531,752, dated Sep. 11, 2015, 4 pgs.
Jodi Volz, Notice of Allowance, U.S. Appl. No. 29/531,752, dated Dec. 14, 2015, 5 pgs.
Jodi Volz, Office Action, U.S. Appl. No. 29/488,839, dated Nov. 10, 2015, 5 pgs.
Jodi Volz, Notice of Allowance, U.S. Appl. No. 29/488,839, dated Apr. 21, 2016, 6 pgs.
Jodi Volz, Notice of Allowance, U.S. Appl. No. 29/488,838, dated Aug. 22, 2016, 5 pgs.
Jodi Volz, Office Action, U.S. Appl. No. 14/694,872, dated Aug. 5, 2016, 14 pgs.
Jodi Volz, Office Action, U.S. Appl. No. 29/573,786, dated Jul. 12, 2017, 4 pgs.
Jodi Volz, Notice of Allowance, U.S. Appl. No. 29/573,786, Dec. 19, 2017, 5 pgs.
Jodi Volz, Final Office Action, U.S. Appl. No. 14/694,872, dated Jun. 20, 2017, 18 pgs.
Jodi Volz, Office Action, U.S. Appl. No. 14/694,872, dated Nov. 27, 2017, 5 pgs.
Jodi Volz, Quayle Office Action, U.S. Appl. No. 29/559,017, dated Aug. 24, 2017, 9 pgs.

* cited by examiner

DISPLAY UNIT CONFIGURED FOR QUICK ASSEMBLY

RELATED APPLICATIONS

This application is a continuation-in-part of U.S. patent application Ser. No. 14/694,872, filed Apr. 23, 2015, which claims priority to U.S. Provisional Application No. 61/983,421, filed Apr. 23, 2014, each of which is hereby incorporated by reference in its entirety.

This application is related to U.S. Design patent application Ser. No. 29/488,838, filed Apr. 23, 2014, to U.S. Design patent application Ser. No. 29/488,839, filed Apr. 23, 2014, to U.S. Design patent application Ser. No. 29/488,840, filed Apr. 23, 2014, now U.S. Design Pat. No. D735,510, to U.S. Design patent application Ser. No. 29/531,752, filed Jun. 29, 2015, and to U.S. Design patent application Ser. No. 29/559,017, filed Mar. 23, 2016, filed herewith. Each of these applications is hereby incorporated by reference in its entirety.

TECHNICAL FIELD

The disclosed embodiments relate generally to temporary display racks, display units, or stands with printed information (e.g., a scannable display code for retail activation) that are used, for instance, in retail stores to temporarily hold one or more particular products or fungible goods such as food products, cleaning products, health products, hardware products, and the like for a specific marketing campaign. In some instances, the display unit includes tabbed shelves and a pre-adhered (i.e., before shipment of the display unit) foldable frame with receiving slots for a predetermined shelf height, so that the foldable frame is easily constructed into the display unit with shelves having the predetermined shelf height.

BACKGROUND

Supermarkets, home centers, and other retail establishments, may have temporary display racks, display units, or stands used to display products or fungible goods such as food products, cleaning products, health products, hardware products, and other merchandise. Some racks of this type are typically constructed from permanent display materials such as wood, metal, and plastics. These displays are fairly costly to manufacture and ship, making them expensive to purchase and to deploy through Direct Store Delivery (DSD) systems. Because these displays are typically shipped in an unassembled form, assembly generally requires substantial labor and use of tools to erect these displays at the point of sale. Further, these displays are not easily recyclable and, therefore, are rarely recycled, instead ending up in landfills. Other display racks are made wholly or predominantly from corrugated paperboard on which advertising graphics are printed. In many instances, these display stands are produced with a combination of cardboard and internal metal supports that are complicated to put together. Furthermore, the merchants may not fill the temporary display racks with the appropriate items for the intended marketing campaign or may not place the products in the correct location on the shelves. As such, it is common for the temporary display racks to be put together offsite, filled with product, and then shipped to the retail establishment. Shipping in this manner induces wear and tear and sometimes causes damage to the temporary display before it even reaches the merchant. Also, the product being carried may be damaged or leak during shipment. Furthermore, this is a costly and inefficient way of shipping the product and the temporary display rack. Additionally, the product manufacturer or consumer package good company running the marketing campaign does not know when (or even if) the merchant places the temporary display in the retail establishment and activates the campaign.

Additionally, when display racks are made wholly or predominantly from corrugated paperboard, a display rack of the type noted above tends to wick water from its lower edges so as to lose its structural integrity when a floor on which the display rack is standing is cleaned. Also, such a display rack tends to damage easily at its lower edges if struck (e.g., by a cleaning appliance, person, shopping cart, or a child's toy). In some instances, the temporary display rack may carry as much as one hundred fifty pounds of displayed merchandise. Consequently, it can be very difficult to push, pull, or turn the display rack carrying displayed merchandise without stressing its lower edges and risking structural integrity damage.

It would be advantageous to provide a mechanism and method for providing a temporary display rack that overcomes the limitations discussed above.

SUMMARY

The embodiments of the invention(s) described herein overcome the various limitations and disadvantages described above. Specifically, the specification describes a temporary display rack (also referred to interchangeably herein as a display unit) with at least some of components that are constructed from recyclable material. The temporary display rack can be shipped flat and assembled quickly on site without requiring the use of tools. Furthermore, the temporary display rack described herein includes a mechanism to assist merchants in placing the desired products on the shelves in the desired position. The temporary display rack described herein also includes a mechanism for the product manufacturer or consumer package good company running the marketing campaign to receive feedback indicating when the marketing campaign is active at the merchant (e.g., when the temporary display rack has been unpacked, assembled, and/or placed on the retail floor with product). The temporary display rack described herein also includes a mechanism that protects the bottom of the display rack from water and wear and tear. The temporary display rack described herein also includes a mechanism to allow movement of the temporary display rack without risking structural integrity damage.

The following presents a summary of the invention in order to provide a basic understanding of some of the aspects of the invention. This summary is not an extensive overview of the invention. It is not intended to identify key/critical elements of the invention or to delineate the scope of the invention. Its sole purpose is to present some of the concepts of the invention in a simplified form as a prelude to the more detailed description that is presented later.

In one aspect of the disclosure, a temporary display rack is provided. The temporary display rack may be used for instance as a specialty display in a retail store for a limited time marketing campaign. The temporary display rack includes a chassis (e.g., a disposable chassis) which has at least two display panels affixed with display graphics and a scannable display code (e.g., a unique scannable display code) for retail activation. In some embodiments, the chassis of the temporary display rack is a foldable frame (e.g., vertical panels joined together at vertical fold lines that are formed out of a display graphic that is attached to an exterior surface of the foldable frame). The temporary display rack also includes a plurality of shelves (e.g., disposable shelves) configured to be supported by the disposable chassis. The disposable chassis and the plurality of disposable shelves are typically made of a honeycombed cardboard material. In some embodiments, the shelves include one or more item codes that correspond to a particular item to be placed on that shelf or below the item code. The temporary display rack also includes a base that is configured to support the chassis and shelves. In some embodiments, the base is re-usable. Typically, the re-useable base is made of durable material such as plastic, medium density fiberboard (MDF), fiberwood, wood, and/or metal, and as such it can be kept and used with a new disposable chassis and a new plurality of disposable shelves for a new marketing campaign. In some instances the base is a pallet made of wood or other suitable materials, sized to fit the chassis. In some instances the base also includes wheels.

In some embodiments, the temporary display rack is a display unit. The display unit may be used for instance as a specialty display in a retail store for a limited time marketing campaign. The display unit includes a foldable frame (e.g., a chassis, shell, rigid structure, case, casing, body that is capably of collapsing or folding). The foldable frame includes a plurality of vertical panels that are joined at vertical fold lines (e.g., a first side panel, a second side panel and a back panel that are coupled together (with one or more hinges) prior to shipment of the display unit). For example, the foldable frame includes at least a first and a second vertical panel and the first vertical panel is joined with the second vertical panel at a respective vertical fold line. In some embodiments, the respective vertical fold line is formed out of a display graphic that is attached to an exterior surface of the foldable frame (more specifically and continuing the above example, the display graphic may cover an exterior surface of the first vertical panel and extend on to an exterior surface of the second vertical panel, such that a vertical fold line is formed between the first and second vertical panels). The exterior surface of the first vertical panel, in some embodiments, is covered by a display graphic that extends on to the exterior surface of second vertical panel, thus forming vertical fold line therebetween. In some embodiments, the foldable frame has a scannable display code for retail activation (as discussed in detail below). The foldable frame is also configured to support at least one shelf.

In another aspect, a flat kit for a temporary display rack is provided. The flat kit is foldable such that it can be shipped in a flat configuration. The flat kit includes a chassis (e.g., a hinged chassis, such as one formed by a plurality of vertical panels joined at vertical fold lines) including a first side panel, a back panel, and a second side panel. The chassis may also include a first hinge apparatus connecting the first side panel to the back panel such that a planar surface of the first side panel at least partially overlaps and contacts a planar surface of the back panel in a folded position. The chassis further includes a second hinge apparatus connecting the second side panel to the back panel such that a planar surface of the second side panel at least partially overlaps and contacts a planar surface of the first side panel in a folded position. In some embodiments, each panel is connected with an adjoining panel at a vertical fold line (e.g., the first side panel is connected with the back panel at a vertical fold that extends along the length of the first side panel). The flat kit also includes a plurality of shelves configured to be supported by the hinged chassis when unfolded and assembled. When the first and second side panels are in their respective folded positions, the hinged chassis is configured to be transportable along with the plurality of shelves as a flat kit for subsequent assembly into a temporary display rack. In some embodiments, the flat kit also includes a re-usable base configured to support the temporary display rack when assembled. In some embodiments, the flat kit includes a disposable pallet base configured to support the assembled temporary display rack.

In some embodiments, a flat kit is provided that includes components for assembling a display unit that includes a foldable frame and a pallet base. The foldable frame includes: (i) a plurality of vertical panels joined at vertical fold lines and (ii) a scannable display code for retail activation. The flat kit also includes: at least one shelf configured to be supported by the foldable frame when the foldable frame is folded in a substantially rigid-angled position. The foldable frame is folded into a substantially flat-folded position for inclusion in the flat kit, such that a substantially planar surface of a first vertical panel of the plurality of vertical panels at least partially overlaps and contacts a substantially planar surface of a second vertical panel of the plurality of vertical panels. Also, the foldable frame is configured to be transportable while in the substantially flat-folded position along with the at least one shelf as the flat kit for subsequent assembly into the display unit.

Another aspect of the disclosure is a method for assembling a display rack. In some embodiments, a first side panel, a back panel, and a second side panel are each provided. Furthermore, a first hinge apparatus with a first flap having first adhesive material covered with a first removable backing is provided. The first backing is removed from the first flap. The first side panel is connected to the back panel via the first adhesive material of the first hinge. Similarly, a second hinge apparatus comprising a second flap having second adhesive material covered with a second removable backing is provided. The second backing is removed from the second flap. The second side panel is connected to the back panel via the second adhesive material of the second hinge. As such, a chassis is formed from the first side panel, the back panel, and the second side panel connected to one another via the first and second hinge apparatuses. In some embodiments, the panels are already joined to one another via vertical fold lines prior to shipment and no formation of the chassis is necessary. For example, a display graphic may be adhered to a first vertical panel and extend on to a second vertical panel (e.g., leaving at least one inch of display graphic material between the first and second vertical panels, so that they are capable of folding at the respective vertical fold line), thus forming a respective vertical fold line between the first vertical panel and the second vertical panel.

In some embodiments of the method discussed above, one or more shelves are also provided. Each shelf of the one or more shelves is connected to the chassis. In some embodiments, a respective shelf is connected to the chassis by inserting a tab on the shelf into a corresponding slot of the side or back panels of the chassis. In some embodiments, the shelves are attached to one or both of the side panels before the back panel is attached to the side panel and before the first and second hinges are attached to the back panel. In some embodiments, the chassis is also inserted, via similar tabs and slots, into a re-usable base that may have wheels. In some embodiments, the chassis is inserted into a pallet base that is made of wood or other suitable materials. In some embodiments, the assembly of the display rack may be performed in two minutes or less. In some embodiments, in order to allow for quick assembly, vertical panels are pre-configured into a foldable frame (e.g., each vertical panel is pre-adhered to one or more adjoining vertical panels) before shipment of the display unit to a merchant.

In some embodiments, a method for quick assembly of a display unit includes: providing a foldable frame, the foldable frame including (i) a plurality of vertical panels joined at vertical fold lines and (ii) a scannable display code for retail activation. The method also includes: folding the foldable frame along each vertical fold line of the vertical fold lines, such that the foldable frame is in a substantially rigid-angled position. In conjunction with folding the foldable frame, the method further includes: connecting at least one shelf to the foldable frame, such that the foldable frame while in the substantially rigid-angled position supports the at least one shelf. In some embodiments, the foldable frame includes slots that are at predetermined positions, so that the display unit has shelves of a predetermined height that is able to provide sufficient space to display a particular product (e.g., the predetermined height is determined by a supplier prior to shipment of the display unit, so that when the shelves are inserted in the receiving slots, the display unit has the shelves with the correct heights for displaying the particular product).

Thus, these mechanisms and methods provide new, less cumbersome, and more efficient ways to provide, ship, and assemble a temporary display rack.

Various embodiments of systems, methods, and devices within the scope of the appended claims each have several aspects, no single one of which is solely responsible for the desirable attributes described herein. Without limiting the scope of the appended claims, some prominent features are described herein. After considering this discussion, and particularly after reading the section entitled "Description of Embodiments," one will understand how the features of various embodiments are used.

BRIEF DESCRIPTION OF THE DRAWINGS

For a better understanding of the aforementioned aspects of the invention as well as additional aspects and embodiments thereof, reference should be made to the Description of Embodiments below, in conjunction with the following drawings in which like reference numerals refer to corresponding parts throughout the figures.

DESCRIPTION OF EMBODIMENTS

Figure 1A:
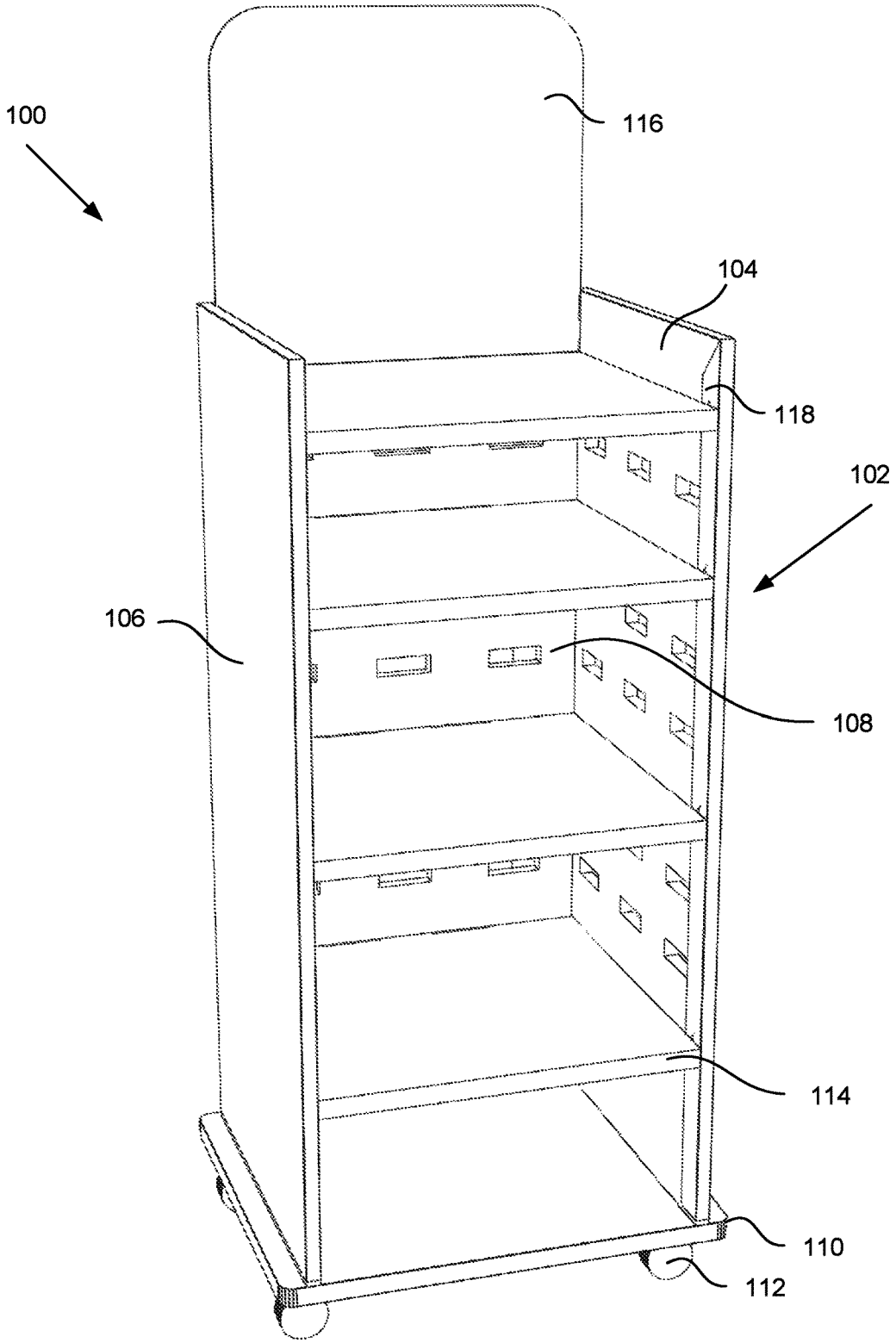
FIG. 1A is a perspective view of a temporary display rack, in accordance with some embodiments.

Reference will now be made in detail to embodiments, examples of which are illustrated in the accompanying drawings. In the following detailed description, numerous specific details are set forth in order to provide a thorough understanding of the present embodiments. However, it will be apparent to one of ordinary skill in the art that the present various embodiments may be practiced without these specific details. In other instances, well-known components and methods have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another (e.g., first side panel and second side panel). For example, a first element could be termed a second element, and, similarly, a second element could be termed a first element, without changing the meaning of the description, so long as all occurrences of the first element are renamed consistently and all occurrences of the second element are renamed consistently. The first element and the second element are both elements, but they are not the same element.

The terminology used in the description of the embodiments herein is for the purpose of describing particular embodiments only and is not intended to be limiting of the claims. As used in the description of the embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," as well as the terms "includes" and/or "including" when used in this specification, specify the presence of stated features, integers, steps, operations, elements, and/or components, but do not preclude the presence or addition of one or more other features, steps, elements, components, and/or groups thereof. Furthermore, as used herein, the term "if" may be construed to mean "when" or "upon" or "in response to," depending on the context.

Many of the components of the temporary display rack described below are made of recyclable (e.g., honeycomb cardboard) material and are held in an assembled relationship by inter-fitting tabs and receiving slots. These components are lightweight, particularly relative to their strength, are easy to transport, and are capable of being set-up within the retail environment in two minutes or less. The manner in which the various structural components and graphics panels fit together provides a distinct advantage in terms of structural performance and ease of assembly, permitting the display racks to be efficiently deployed in the retail environment (and in such a way that ensures merchants are also complying with supplier requirements or requirements specific to a particular marketing campaign with which the display rack is associated).

Figure 1B:
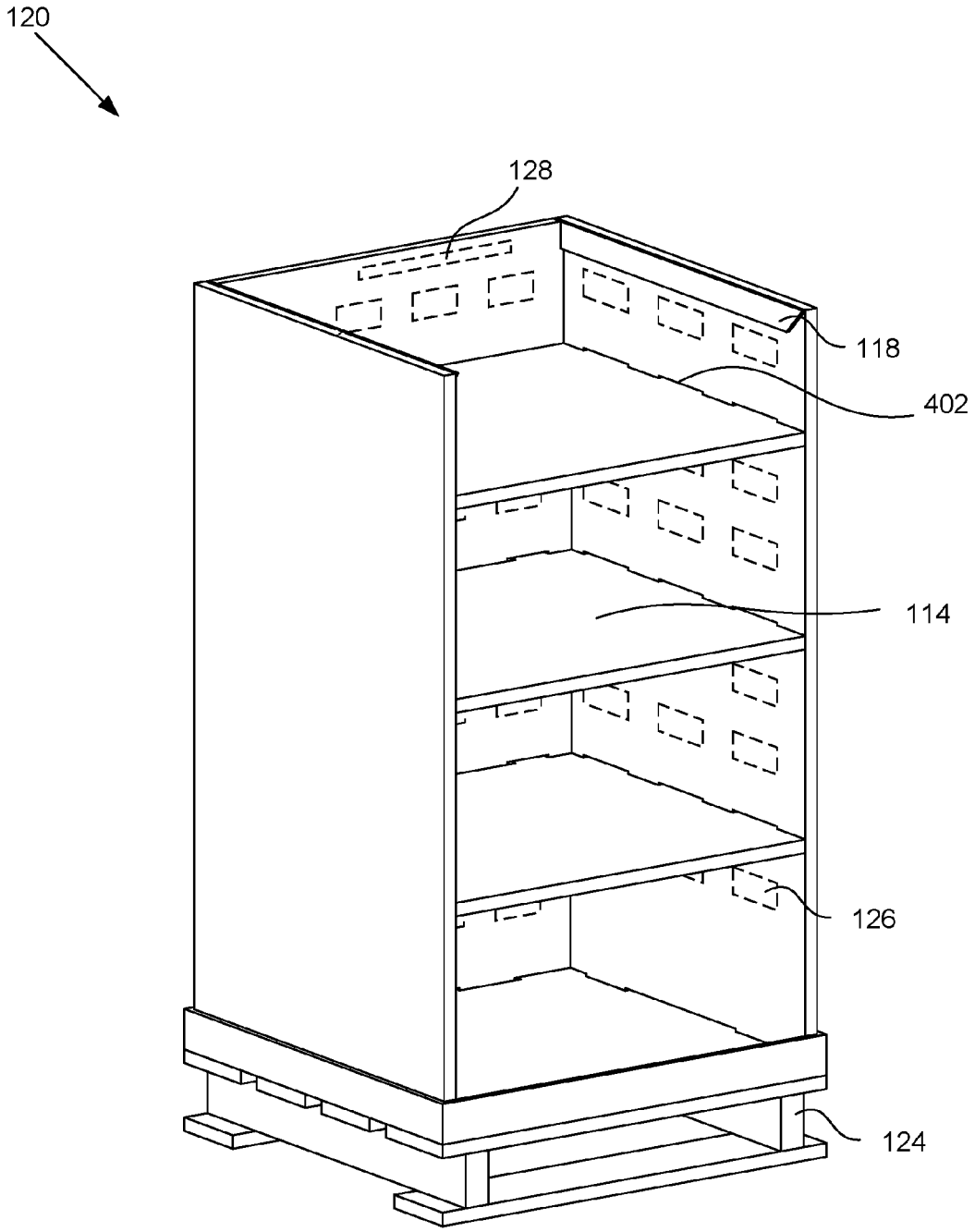
FIGS. 1B and 1C are perspective views of a display unit, in accordance with some embodiments.

FIG. 1A is a perspective view of a temporary display rack 100. In some embodiments or circumstances, the temporary display rack 100 is referred to as a display unit (e.g., display unit 120, FIGS. 1B and 1C) and, thus, the terms are used interchangeably herein. Also, to avoid repetition, even though some features of the embodiments disclosed herein are described to particular embodiments (e.g., with reference to one of temporary display rack 100 or display unit 120) these features may still apply to all embodiments. In some embodiments, the temporary display rack 100 includes a chassis 102 having a first side panel 104, a second side panel 106, and a back panel 108. In other embodiments, more or fewer panels are included in the chassis 102. For instance, in some embodiments, the chassis 102 includes only the first side panel 104 and the second side panel 106 but not the back panel 108, as such, in this embodiment product placed on the temporary display rack 100 can be viewed from the front and the back of the rack. As illustrated in FIG. 1A, some embodiments include a base 110, with wheels 112. As illustrated in FIG. 1B, some alternative embodiments include a pallet base 124 instead of the base 110. In some embodiments, both the base 110 and the pallet base 124 are provided, so that a merchant can use either type of base with the display rack. The base 110 elevates the chassis 102 above a floor.

Figure 1C:
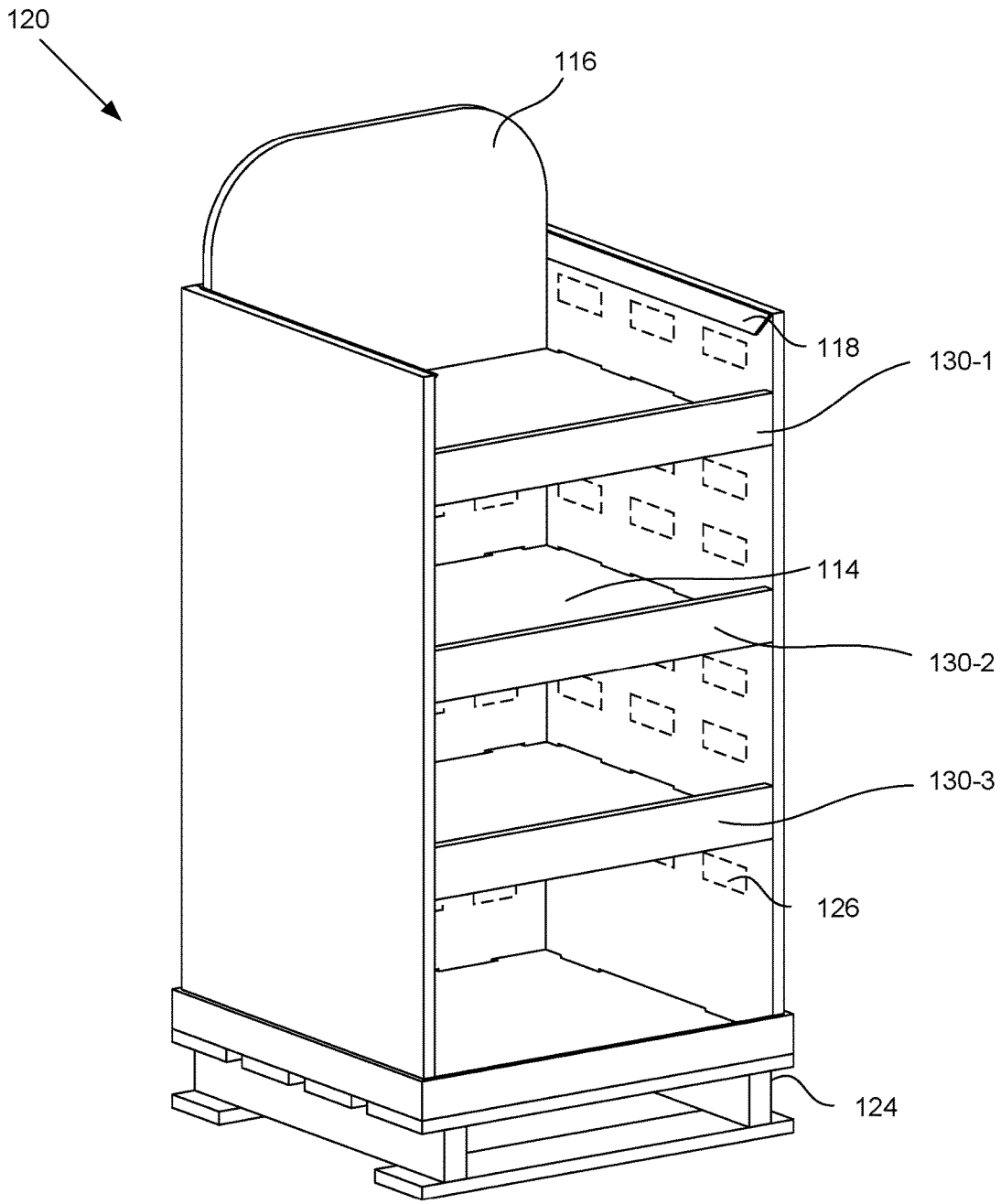

The temporary display rack 100 also includes a plurality of shelves 114, which are configured to be supported by the components (e.g., the first side panel 104, the second side panel 106, and/or the back panel 108) of the chassis 102. Furthermore, as illustrated in FIG. 1A, some embodiments also include a header piece 116, which extends at least partially above the chassis 102. Typically, the header piece 116 is an optional and non-structural component used to display images, information, or advertising. In some embodiments, the header piece is thinner than the first side panel 104, the second side panel 106, and the back panel 108. In some embodiments, the header piece is configured to slide between a top shelf of the plurality of shelves 114 and the back panel 108. In some embodiments, after sliding the header piece between the top shelf and the back panel, the header piece extends above the top of the first side panel 104, the second side panel 106, and/or the back panel 108 (in this way, the header piece is visible at a greater distance and can be used to attract attention from consumers standing at some distance from the temporary display rack 100). In some embodiments, the header piece 116 is secured to the display unit via a strip of twin stick (e.g., twin stick 128, FIG. 1B). Consistent with these embodiments, FIG. 1C shows a display unit with an attached header piece 116 secured to the display unit 120 via the twin stick 128.

In some embodiments, a plurality of temporary display racks 100 (or display units 120, FIGS. 1B-1C) are configured to be attached to one another (e.g., hooked together) to create a display having a larger footprint, such as a half-pallet or full-pallet footprint.

Typically, the temporary display rack 100 includes a chassis 102 made of disposable material, i.e., it is a disposable chassis 102. As such, the first side panel 104, the second side panel 106, and the back panel 108 are made of a disposable material. Similarly, the shelves 114 are made of a similarly-disposable material, i.e., they are disposable shelves 114. In some embodiments, the disposable chassis 102 and the disposable shelves 114 are made of recyclable fiber-based materials such as containerboard or a honeycomb cardboard described in more detail with respect to FIG. 9.

Figure 2A:
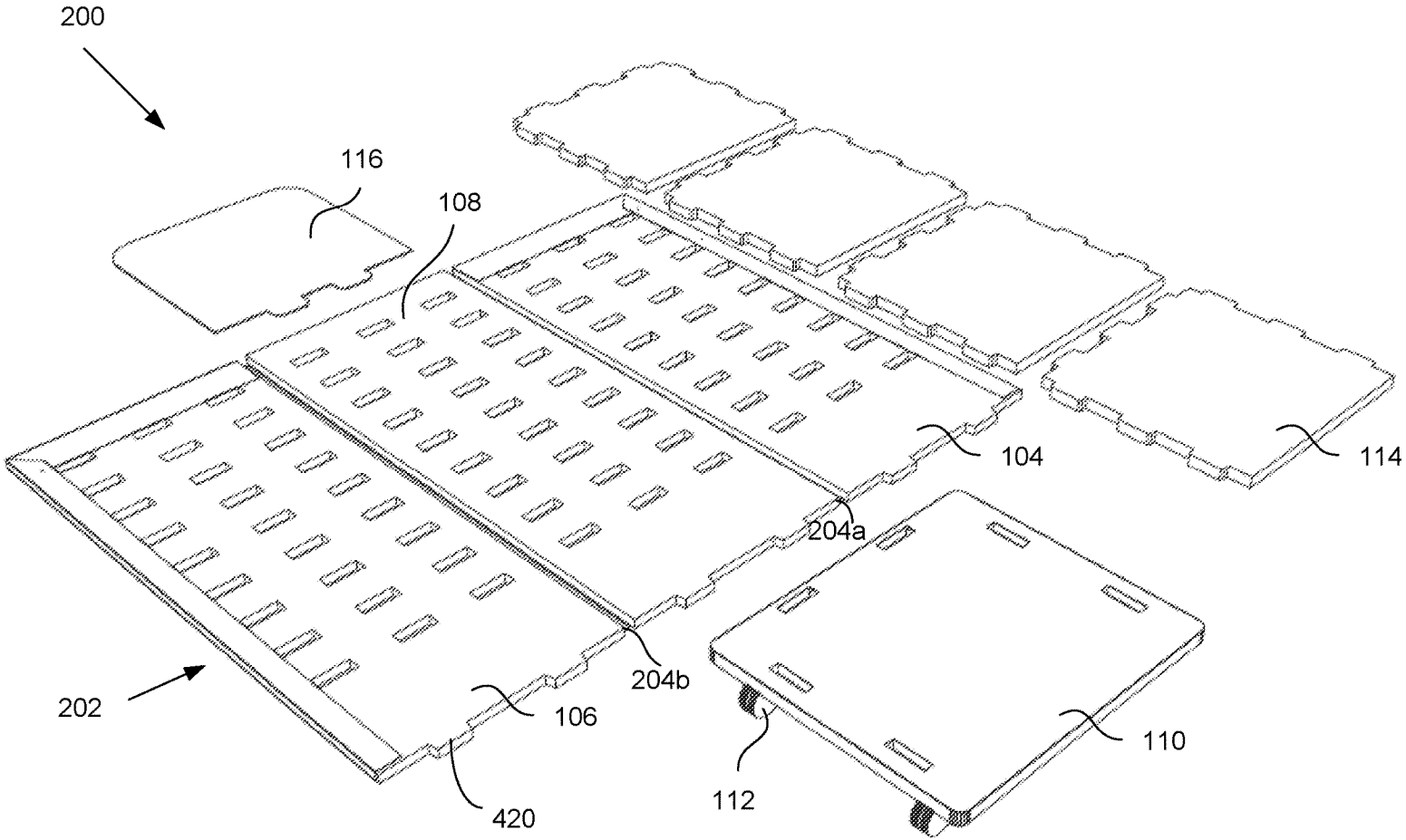
FIG. 2A is a perspective view of the disassembled components of a temporary display rack including, side panels, a back panel, shelves, a base with wheels, and a header piece, in accordance with some embodiments.
Figure 2B:
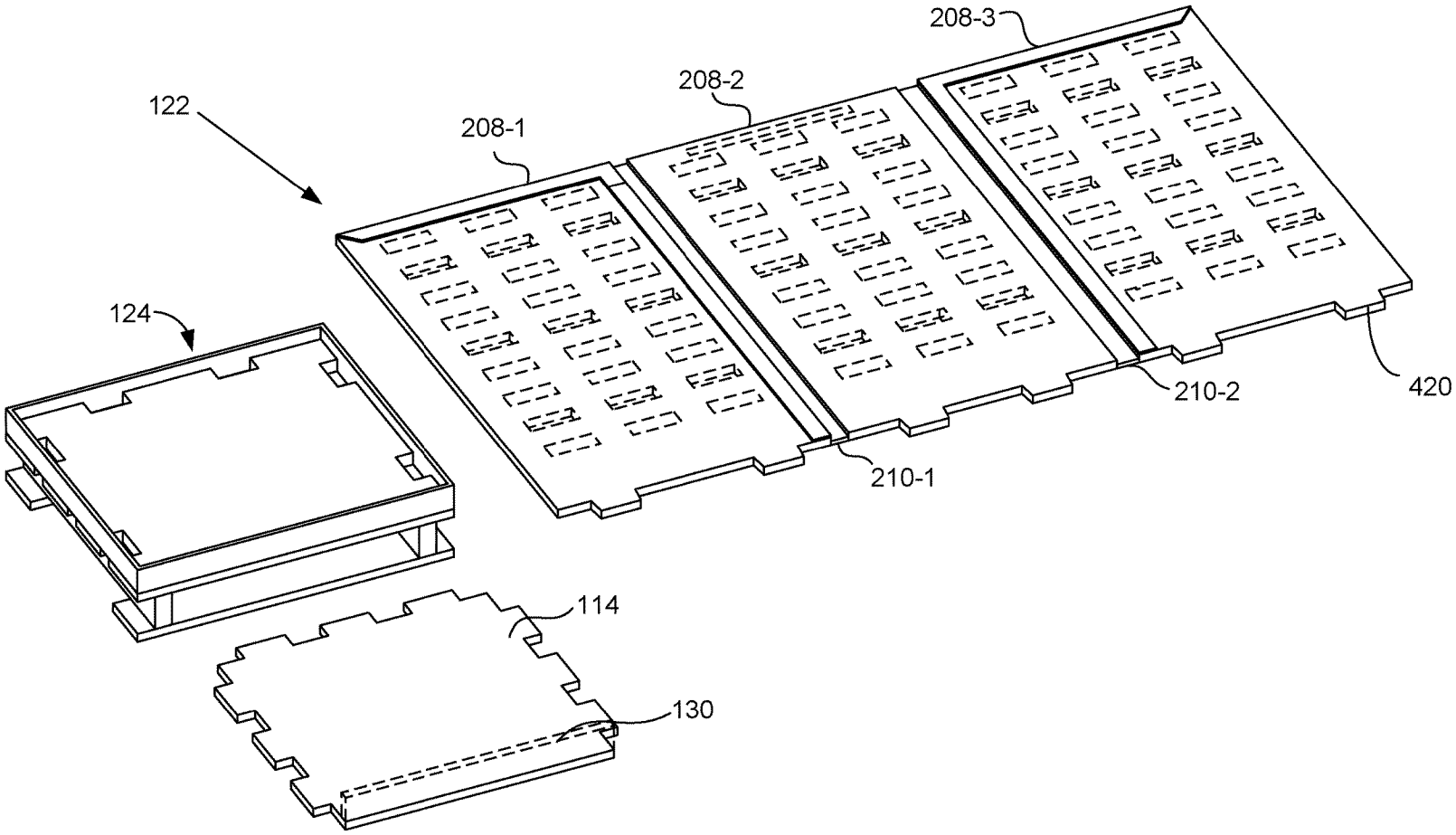
FIG. 2B is a perspective view of the disassembled components of a display unit including a foldable frame that includes a plurality of vertical panels joined at vertical fold lines, shelves, and a pallet base, in accordance with some embodiments.
Figure 10:
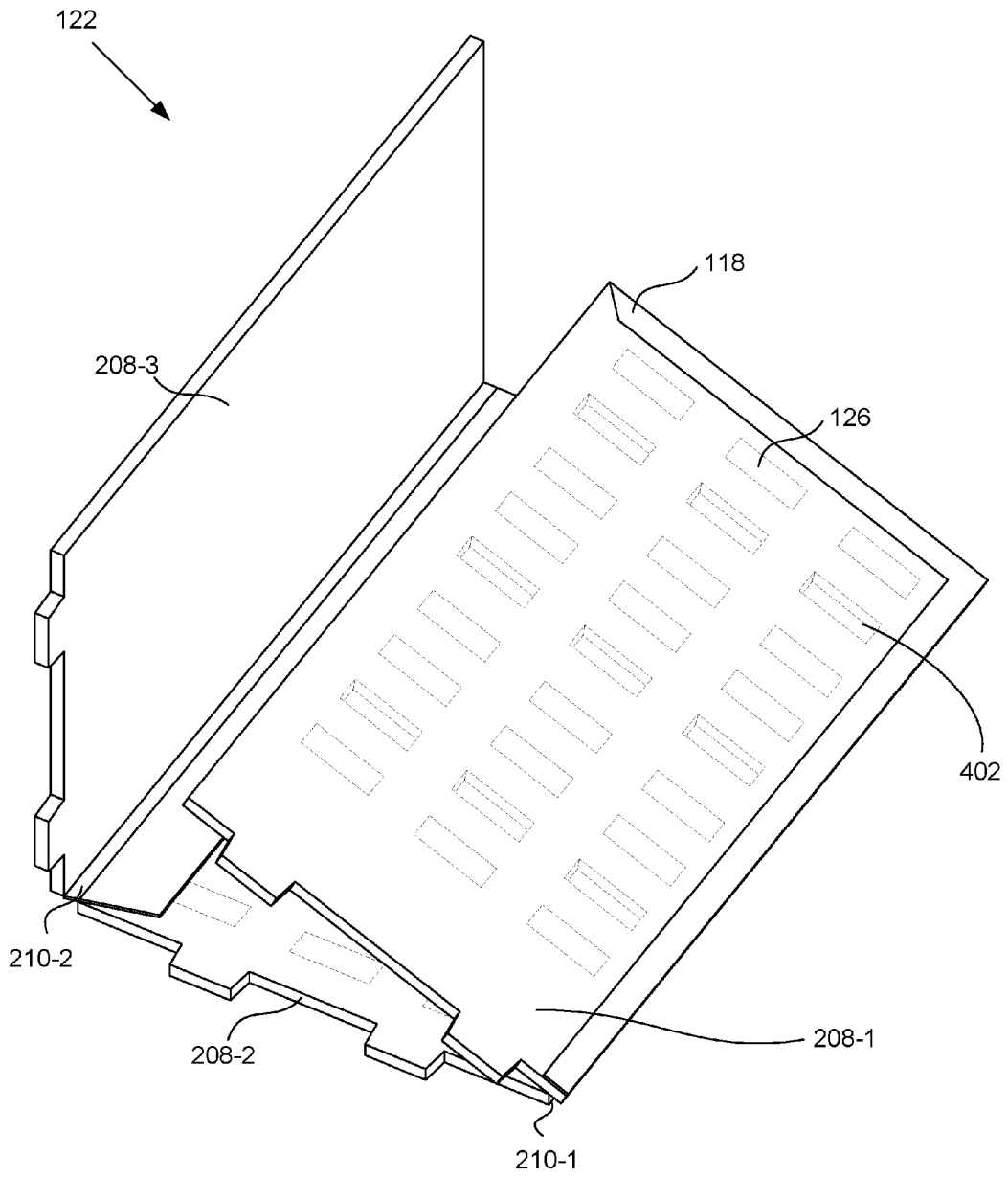
FIG. 10 is a perspective view of an example foldable frame that is in the process of being folded into a substantially flat-folded position, in accordance with some embodiments.
Figure 11:
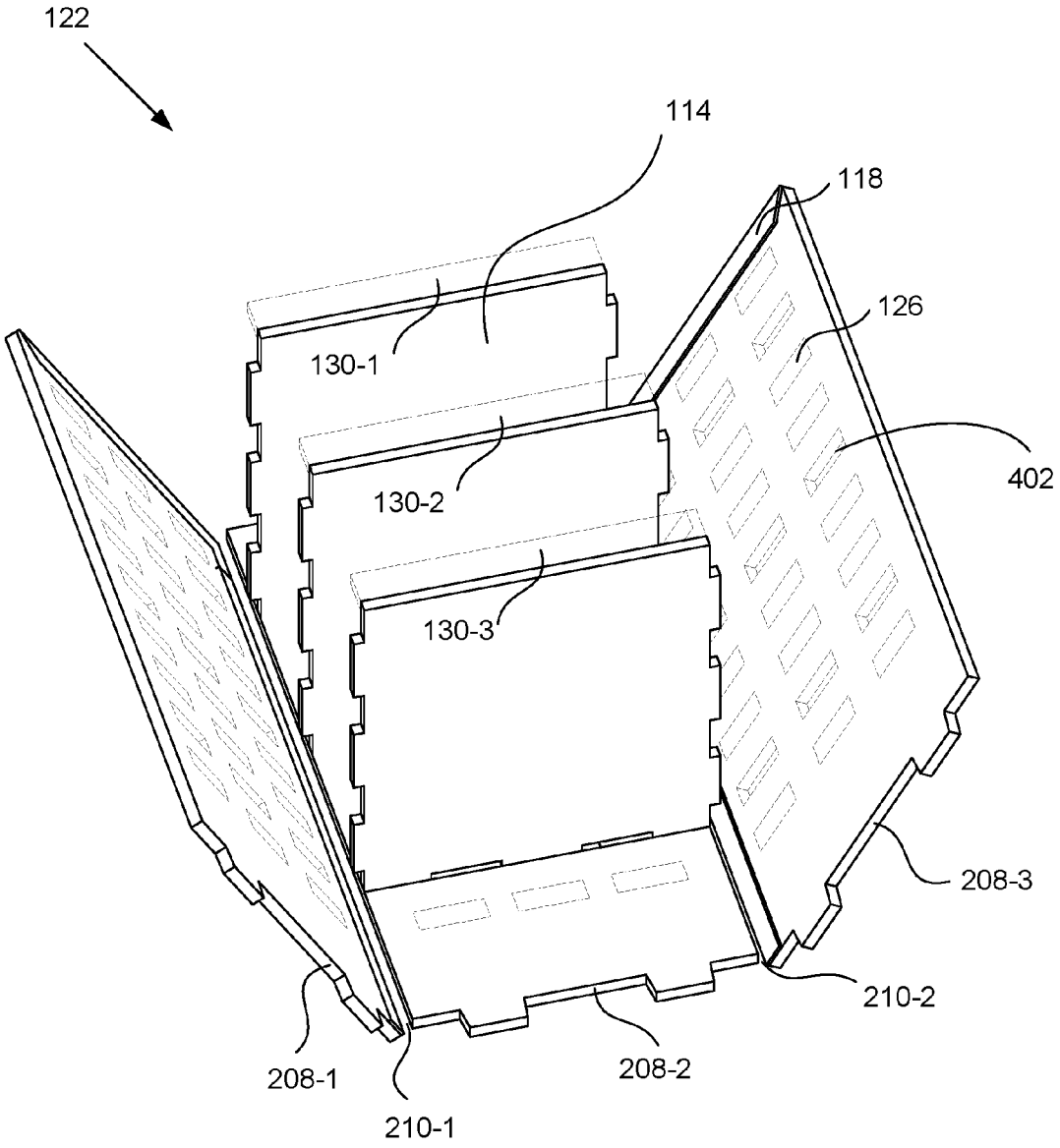
FIG. 11 is a perspective view of an example foldable frame that is in the process of being folded into a substantially rigid-angled position, in accordance with some embodiments.

In some embodiments, the chassis 102 of FIG. 1A is a foldable frame 122 (e.g., a chassis, shell, rigid structure, case, casing, body that is capable of collapsing or folding) as illustrated in FIGS. 2B, 10, and 11. As shown in FIG. 2B, the foldable frame 122 includes a first vertical panel 208-1, a second vertical panel 208-2, and a third vertical panel 208-3 and each vertical panel is coupled with an adjacent vertical panel via a vertical fold line there between. In some embodiments, the first vertical panel 208-1 is the first side panel 106 (FIG. 1A), the second vertical panel 208-2 is the back panel 108 (FIG. 1A), and the third vertical panel 208-3 is the second side panel 104 (FIG. 1A). Thus, in some embodiments, the foldable frame 122 is fully constructed (i.e., each of the panels is already connected without having to attach them using an adhesive as explained above) prior to shipping the components of the display unit (e.g., using a flat kit as described below).

In some embodiments, the chassis 102 and shelves 114 are affixed with display graphics 118 (i.e., the display graphics are either permanently affixed or temporarily/removably attached). In some embodiments, when assembled, the display graphics 118 (also referred to herein as graphics or graphics layer 118) cover substantially all of the exterior surface(s) of the first side panel 104 and the second side panel 106. In some embodiments, the back panel 108 has display graphics 118 only partially covering its exterior surface. In other embodiments, substantially all of or the majority of the back panel 108 is also affixed with display graphics 118 (i.e., the display graphics are either permanently affixed or temporarily/removably attached to the back panel). Similarly, in some embodiments, the shelves 114 are affixed with display graphics on substantially all of the showing assembled surfaces (i.e., the display graphics are either permanently affixed or temporarily/removably attached to the shelves). In other embodiments, only the top surface and/or top and front surfaces of the shelf are affixed with display graphics.

In some embodiments, the display graphics are designed (or configured to) cover slots extending through the exterior surfaces of the back panel 108, first side panel 104, and/or second side panel 106. In some embodiments, the display graphics are pre-adhered (e.g., attached using any known adhering technique, including magnets, hooks, adhesives, and the like) to the vertical panels of the foldable frame (e.g., to an exterior surface of each vertical panel), while in other embodiments, the display graphics are not initially adhered (i.e., when a flat pack that includes the components of the display unit is shipped, the exterior surfaces of the vertical panels are not attached to the display graphics). In these other embodiments, the display graphics are included separately from the vertical panels and are adhered at a later point in time. In this way, the exterior surfaces appear smooth and only the display graphic is visible, creating a pleasing and attractive aesthetic appearance on the exterior surfaces of the temporary display rack (e.g., an exterior surface of each of the vertical panels).

Turning now to FIG. 1C, in some embodiments, the shelves 114 include lips 130 (e.g., lips 130-1 through 130-3 extend vertically in an upward direction when viewing the display unit from a front view/normal view). In some embodiments, display graphics are affixed to the lips 130 (e.g., to describe product that is included on each shelf). In some embodiments, the lips 130 extend from a first side of the shelves 114, in a substantially perpendicular direction relative to a bottom surface of the shelves 114, and the foldable frame 122 is configured to support the at least one shelf without substantially obscuring the lip.

Utilizing the temporary display rack 100 of FIG. 1A or the display unit 120 of FIGS. 1B and 1C, products that are for sale to the general public are supported and displayed at the point of sale on the temporary display rack 100 or the display unit 120, and the products are placed in prominent locations of a retail establishment for maximum visibility and easy access to the product. Furthermore, in some embodiments, graphics are applied to the temporary display rack 100 to enhance visual attraction to the displayed product (as discussed above). The temporary display rack 100 is designed to support the weight of the displayed product and to withstand the rigors of prolonged use in a retail environment (as discussed in more detail below).

Figure 6:
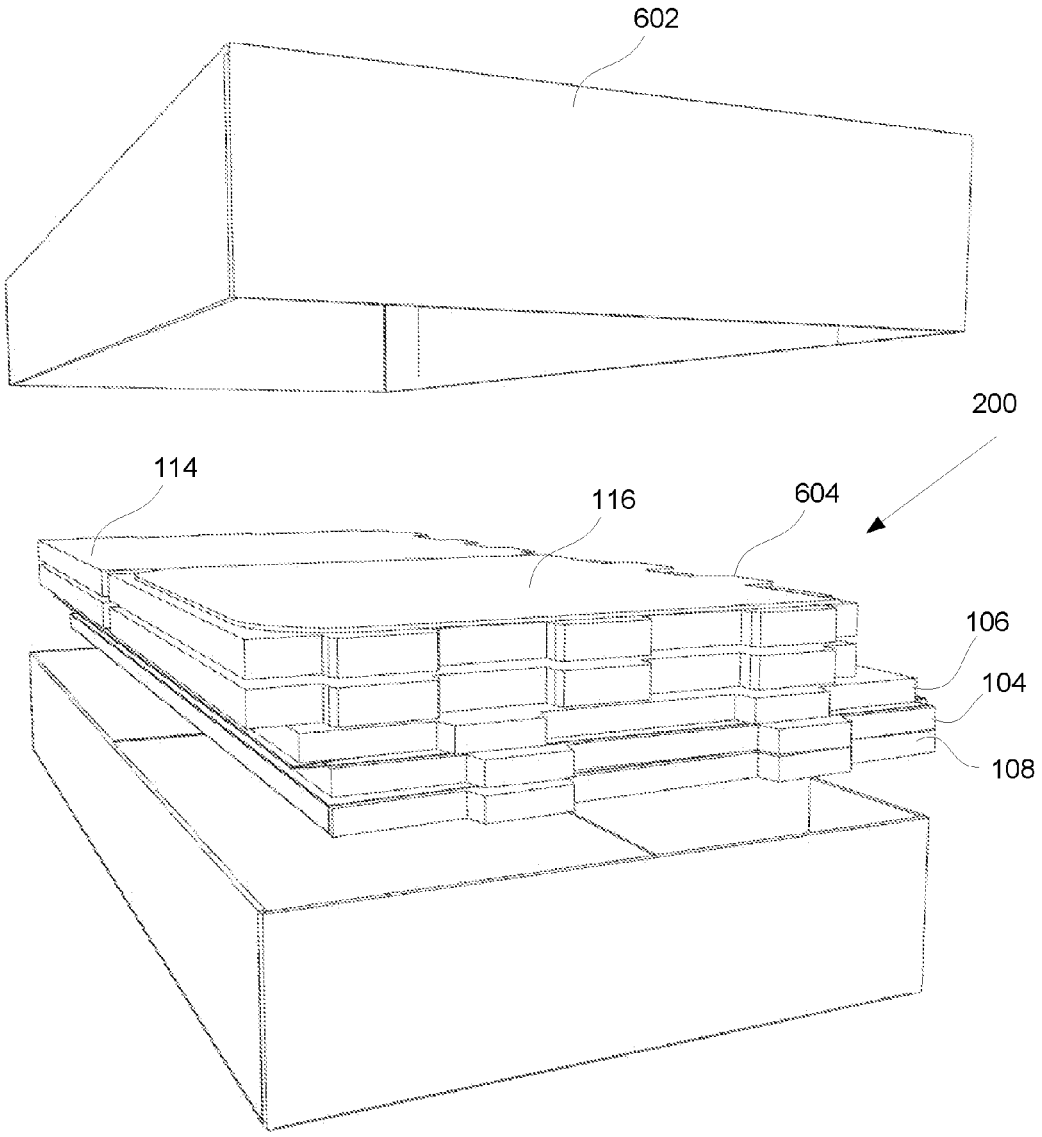
FIG. 6 is an exploded view of a flat kit for a temporary display rack, in which the disassembled components of the temporary display rack are stacked together and inserted into a shipping box, in accordance with some embodiments.

FIG. 2A is a perspective view of the disassembled components of a temporary display rack 100, referred to herein as a flat kit 200 for a temporary display rack. The flat kit 200 is designed such that it can be shipped in a flat configuration. For instance, the components can be stacked on top of one another as illustrated in FIG. 6. As illustrated in FIG. 2A, in some embodiments, the flat kit 200 includes a hinged chassis 202 (e.g., the disposable chassis 102 discussed above is configured for storage as a hinged chassis 202) including a first side panel 104, a back panel 108, and a second side panel 106. The hinged chassis 202 also includes a first hinge apparatus 204*a* connecting the first side panel 104 to the back panel 108 such that a planar surface of the first side panel at least partially overlaps and contacts a planar surface of the back panel in a folded position (as illustrated in FIG. 6.) The chassis further includes a second hinge apparatus 204*b* connecting the second side panel 106 to the back panel 108, such that a planar surface of the second side panel 106 at least partially overlaps and contacts a planar surface of the first side panel 104 in a folded position. In some embodiments, the hinged side panels are designed folded 'backwards,' so that when placed in a shipping box, the back panel 108 lies flat on the bottom of the box when the two side panels are folded and stacked above it. One advantage of this configuration is that the surfaces of the side and back panels that will be on the exterior surfaces when the temporary display rack is assembled are more protected during shipment. For instance, when only the assembled exterior surfaces are affixed with graphics, these graphics are protected from wear and tear by being folded in on one another during shipment.

The flat kit 200 also includes a plurality of shelves 114 configured to be supported by the hinged chassis 202 when unfolded and assembled. In some embodiments or circumstances, the hinged chassis 202 is referred to as a foldable frame (e.g., foldable frame 122, FIG. 2B). The number of shelves 114 provided with the flat kit 200 is dependent upon the size of the product(s) to be placed thereon. For instance, FIG. 2A illustrates four shelves 114, but as many shelves as there are receiving slots in the hinged chassis 202 could be provided. For instance, the hinged chassis 202 illustrated in FIG. 2A could support nine shelves 114. When the first and second side panels 104/106 are in their respective folded positions, the hinged chassis 202 is configured to be transportable along with the plurality of shelves 114 as a flat kit 200 for subsequent assembly into a temporary display rack 100. In some embodiments, the panels are a plurality of vertical panels 208 (FIG. 2B) that is capable of folding into a substantially flat-folded position to be similarly transportable along with the plurality of shelves 114 as a flat kit 200 for subsequent assembly into a display unit 120.

In some embodiments, the flat kit 200 also includes a base 110 configured to support the temporary display rack 100 when assembled. As illustrated in FIG. 2A, the base 110 may include wheels 112. Another optional component of the flat kit 200 illustrated in FIG. 2A is the header piece 116. As seen in FIG. 2B, other embodiments include a pallet base 124 configured to support the display unit 120, illustrated in FIGS. 1B and 1C, when assembled.

In some embodiments, the flat kit 200 described above in reference to FIG. 2A includes a foldable frame 122 (as illustrated in FIG. 2B and the foldable frame 122 is also described in more detail above in reference to FIGS. 1A-1C). In these embodiments, the first hinge apparatus 204*a* and second hinge apparatus 204*b* from the flat kit of FIG. 2A are included as vertical fold lines 210 in the flat kit of FIG. 2B (e.g., vertical fold lines 210-1 and 210-2). In some embodiments, before sending a respective flat kit to a retailer or merchant, a supplier attaches a first side panel 208-1 to back panel 208-2 along a first vertical fold line 210-1 (e.g., by forming a hinge apparatus similar to hinge apparatus 204*b*) and a second side panel 208-3 to back panel 208-2 along a second vertical fold line 210-2 (e.g., by forming a hinge apparatus similar to hinge apparatus 204*a*).

Figure 3:
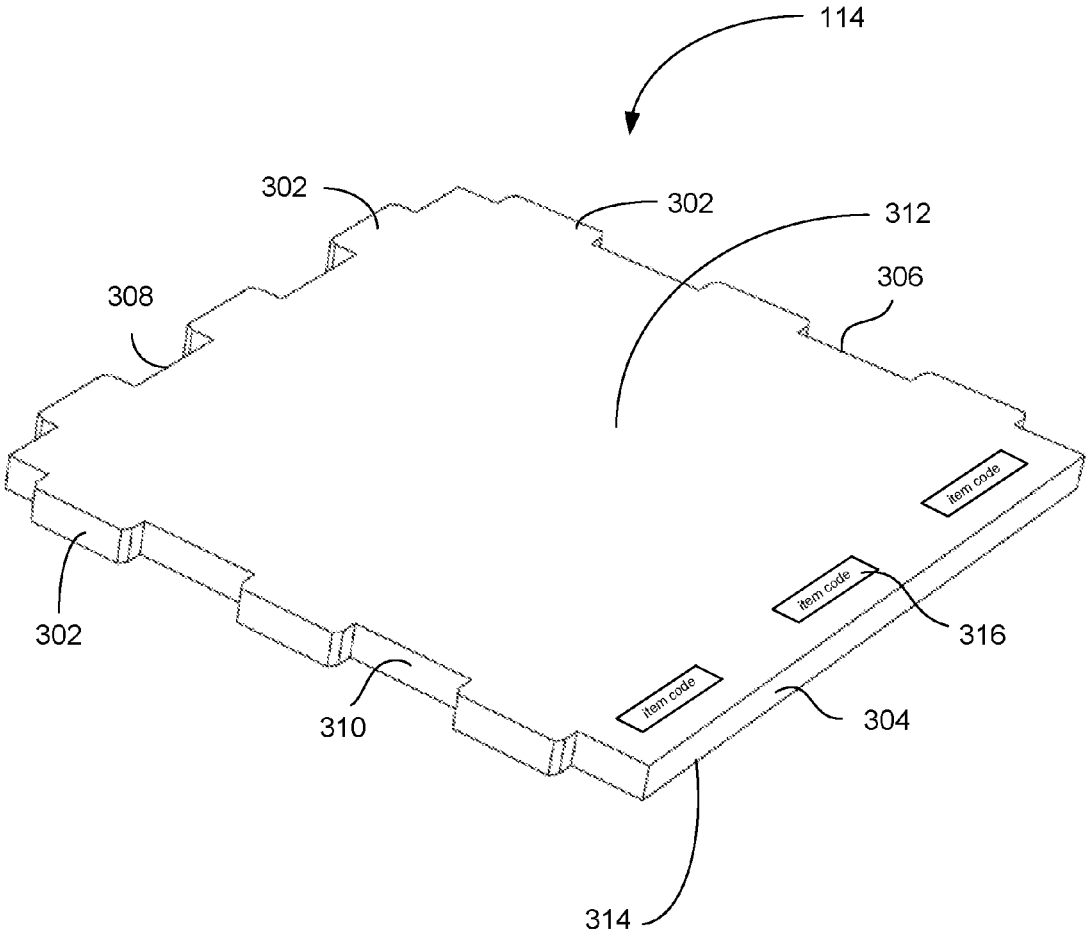
FIG. 3 is a perspective view of an example shelf including a plurality of tabs, in accordance with some embodiments.

FIG. 3 is a perspective view of an example shelf 114. The shelf 114 includes a front surface 304, a first side surface 306, a back surface 308, a second side surface 310, a top surface 312, and a bottom surface 314. In some embodiments, the shelf 114 includes a lip 130 (as shown for the respective shelves pictured in FIGS. 1C and 2A).

As shown in FIG. 3, the shelf 114 includes a plurality of tabs 302. The tabs 302 are sized to substantially fill a corresponding receiving slot in a component of the chassis (e.g., a corresponding slot in the first side panel 104, the second side panel 106, and/or the back panel 108). In some embodiments, the shelf 114 has a plurality of tabs 302 on three of its sides. In other embodiments, the shelf 114 has at least one tab 302 on three of its sides (e.g., all the sides except for the front 304 of the shelf 114 when assembled). In still other embodiments, the shelf 114 has at least one tab 302 on two of its sides.

As discussed below with respect to FIG. 10, the shelf 114 is typically a disposable shelf 114 made of recyclable fiber-based materials such as containerboard or a honeycomb cardboard with a thickness of ¾ of an inch. In some embodiments, the shelf 114 is configured to support at least 45 lbs. In some embodiments the shelf 114 is made of recyclable fiber-based materials such as containerboard or a honeycomb cardboard with a thickness of an inch and is configured to support more than 45 lbs. (e.g., 60, 65, 70, 75 lbs., or even up to 100 lbs.)

Turning back to FIG. 3, in some embodiments, the tabs 302 are integrally formed with the shelf 114 and thus are of substantially the same thickness as the shelf 114. In some embodiments, the shelf 114 is affixed with a graphics layer 118 on substantially all of its surfaces. In some embodiments, the graphics layer 118 that is affixed to the shelf 114 indicates a desired arrangement of product on the shelf (i.e., a particular organization of products, such as organizing the product in three rows and four columns by following instructions on the graphics layer 118). In other embodiments the graphics are affixed on substantially all of the showing assembled surfaces of the shelf 114. For instance, in some embodiments, the graphics layer 118 is not affixed to the tabs 302, because the graphics do not show when the shelf 114 is assembled. In some embodiments, substantially all of the top surface 312 and/or top 312 and front 304 surfaces of the shelf are affixed with a graphics layer 118, but the bottom 314, first side 306, back surface 308, second side surface 310, and all surfaces of the tabs 302 are not affixed with a graphics layer 118. In some embodiments, a minority of the first side 306, back surface 308, second side surface 310 are affixed with graphics. For instance, a portion of these surfaces may be affixed with graphics in order to secure the graphics to the top surface 312 and front surface 304.

In some embodiments, the shelf 114 also includes one or more item codes 316 affixed (or removably attached) thereon. For instance, as illustrated in FIG. 3, three item codes 316 are affixed to the shelf 114. In some embodiments, the item codes 316 are included in the graphics layer 118 affixed to the shelf 114. In other embodiments, as shown in FIG. 3, the item codes 316 are separately affixed to the graphics on the shelf 114 (e.g., via separate stickers.) In some embodiments, a respective item code 316 corresponds to a UPC code for a product to be placed on the corresponding disposable shelf. For instance, in some embodiments, the item code 316 includes price information regarding the product. In some embodiments, the product code provides manufacture and/or distributor information. In some embodiments, when scanned, the item code 316 provides appropriate information to create and print a price label for the shelf and/or for each product included on the shelf.

In some embodiments, the placement of a respective item code 316 indicates the placement location of a corresponding product on the shelf 114 (in some embodiments, the respective item code 316 is used in conjunction with the display graphic 118, in order to identify appropriate product placement). For instance, the item codes 316 in FIG. 3 indicate that three columns of corresponding product should be placed on this shelf (e.g., one column of corresponding product behind each item code). In some embodiments, an item code 316 is associated with a custom planogram indicating correct product placement on the temporary display rack. For example, a respective item code 316 (or one or more item codes 316) is affixed to a respective shelf of the plurality of shelves and the respective item code 316 is associated with a planogram used to determine correct product placement on the respective shelf. In some embodiments, the item codes 316 are displayed on the front surface 304 of the shelf 114, rather than on the top surface 312, and can still be used to guide product placement (e.g., each shelf includes a different planogram to guide product placement). Thus, one of the benefits of using the item codes 316 is that they provide the retailer with visual guides for product placement. This enhances the overall execution of merchandising of a product (e.g., the right product ends up in the right place.) Also, the Consumer Packaging Good Company (CPG) benefits by ensuring that its product is being merchandised according to its respective plan and campaign. Furthermore, the company that produces and delivers the temporary display rack directly assists in creating a merchandising program tied to the calendar (i.e., a merchandising program that changes throughout the calendar year, such as a merchandising program that changes the products displayed in the temporary display rack based on upcoming holidays) with the display vehicle (e.g., the temporary display rack) used on the merchant's floor for the defined sales period before being recycled.

Figure 4:
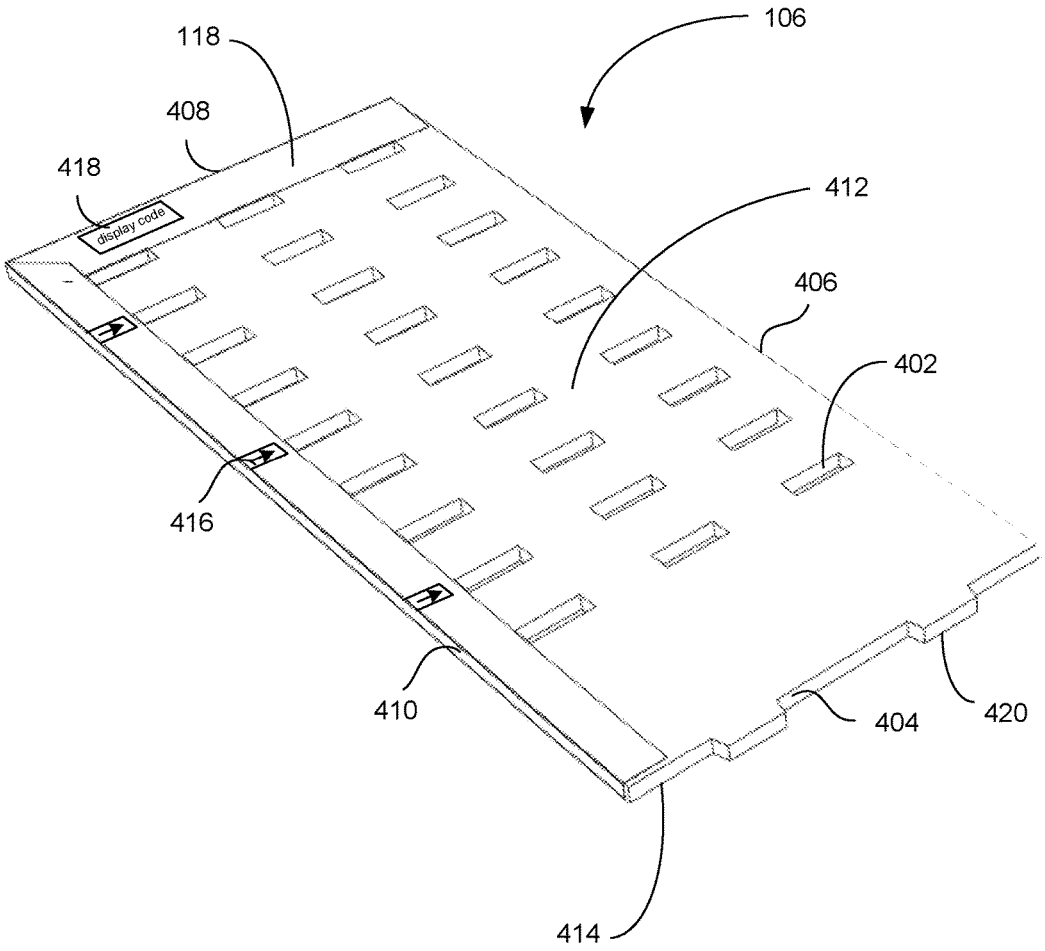
FIG. 4 is a perspective view of an example side panel including a plurality of receiving slots, in accordance with some embodiments.

FIG. 4 is a perspective view of an example side panel, such as the second side panel 106 of FIGS. 1 and 2 (although the description below applies generally to both the first side panel 104 and the back panel 108 of temporary display rack 100 and also applies to the vertical panels 208 of display unit 120). As illustrated in FIG. 4, the side panel 106 includes a bottom surface 404, a first side surface 406, a top surface 408, a second side surface 410, an interior surface 412 (e.g., the surface of the panel 106 that faces inwardly when the temporary display rack is assembled), and an exterior surface 414 (e.g., the surface of the panel 104 that faces outwardly when the temporary display rack is assembled).

The side panel 106 also includes a plurality of receiving slots 402 (in order to avoid creating clutter in the figures, a single receiving slot 402 is labelled in each of FIGS. 4, 10, and 11, but other (unlabeled) receiving slots 402 also appear in each of these figures). Each receiving slot 402 is sized to snugly receive a tab of a shelf 114 (See, e.g., tabs 302 of shelf 114, FIG. 3). The side panel 106 generally has a plurality of columns of receiving slots 402, although some embodiments include only one column of receiving slots 402. The side panel 106 generally also has a plurality of rows of receiving slots 402. In some embodiments, the rows are vertically spaced 4 inches from one another. In some embodiments, when the flat kit 200 is provided, the side panel 106 provided has at least enough rows of receiving slots 402 to receive the number of provided shelves 114 (e.g., the nine rows of receiving slots 402 of side panel 106 receive nine shelves 114). In other embodiments, the side panel 106 includes more rows of receiving slots 402 than the number of shelves 114 provided in the flat kit 200.

In some embodiments the receiving slots 402 are covered by removable perforated coverings 126 as illustrated in FIGS. 1B and 1C (in order to avoid creating clutter in figures, a single perforated covering 126 is labelled in each of FIGS. 1B, 1C, 10, and 11, but other (unlabeled) perforated coverings 126 also appear in each of these figures). As such, the design of side panel 106 allows for various configurations of shelf heights depending on the size and shape of the product to be displayed. Thus, shelves of the temporary display rack, in accordance with these other embodiments, can be adjusted and re-configured during the course of a marketing campaign. Furthermore, a benefit of this flexible side panel design 106 is that one consistent design can be used for many different products in different marketing campaigns.

Figure 5A:
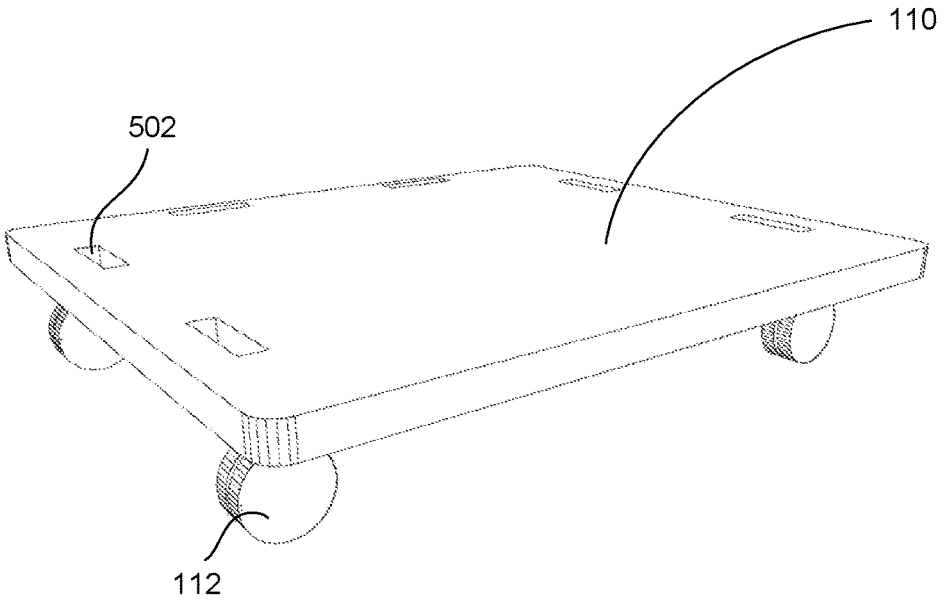
FIG. 5A is a perspective view of an example base with wheels, in accordance with some embodiments.
Figure 5B:
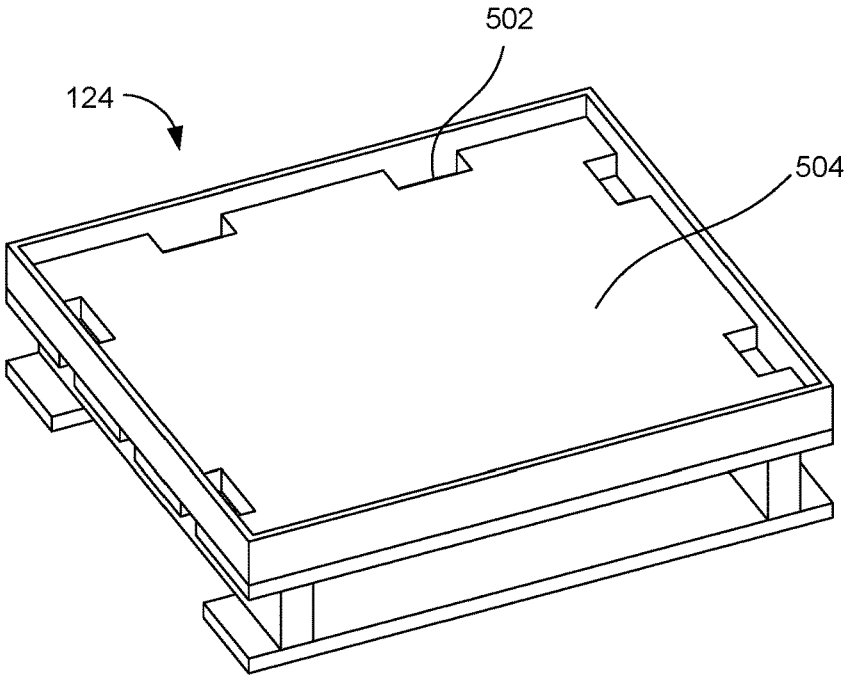
FIG. 5B is a perspective view of an example pallet base, in accordance with some embodiments.

In some embodiments, the temporary display rack includes one or more tabs 420 at a bottom portion of the temporary display rack (e.g., extending from a bottom portion of each vertical panel 208, as shown in FIG. 2B, or extending from a bottom portion of the side panel 106, back panel 108, and side panel 104, as shown in FIG. 2A). The tab(s) 420 are sized to substantially fill a corresponding receiving slot in the base 110 (e.g., receiving slots 502 of base 110, FIG. 5A) or pallet base 124 (e.g., receiving slot 502 of pallet base 124, FIG. 5B. In some embodiments, as illustrated in FIG. 5B, the pallet base 124 also includes a slot-creating insert 504 that, when introduced to the pallet base 124, is shaped to substantially leave receiving slots 502 configured to receive a side panel (e.g., side panel 106, FIG. 2A, or one of the vertical panels 208 of the foldable frame 122, FIG. 2B).

As discussed with respect to FIGS. 1A, 1B and 1C, components of the temporary display rack (e.g., the side panel 106 or the foldable frame 122) are typically disposable and made of recyclable fiber-based materials such as containerboard or a honeycomb cardboard with a thickness of ¾ of an inch. As illustrated in FIG. 4, in some embodiments, the tabs 420 are integrally formed with a respective component of the temporary display rack and thus are of substantially the same thickness as the shelf 114. Similarly, in some embodiments, the receiving slots 402 extend through the side panel 106 and thus are approximately ¾ of an inch in depth. In other embodiments, as discussed with respect to FIG. 3, the thickness of the shelf 114 is one inch and a component of the temporary display rack (e.g., the side panel 106 or a respective vertical panel 208 of the foldable frame 122) is not of substantially the same thickness as the shelf 114.

In some embodiments, the side panel 106 is affixed with graphics on substantially all of the exterior surface 414. In some embodiments, the graphics are affixed to the interior of the side panel 106 or the foldable frame 122 and include removable perforated coverings 126 that substantially obscure, cover, or otherwise hide the receiving slots 402. In some embodiments, the graphics are printed on a graphics layer 118 that covers the receiving slots 402 such that the exterior of the side panel 106 appears to have a smooth, unblemished, solid face for displaying graphics. In some embodiments, as illustrated in FIG. 4, the graphics layer 118 covers the top surface 408, the front surface (which is the second side surface 410 in FIG. 4), and at least a portion of the interior surface 412. In some embodiments, the graphics layer 118 affixed to the interior surface 412 of the side panel 106 includes shelf placement indications 416, indicating where each of the plurality of disposable shelves 114 should be placed. For instance, in some embodiments, the graphics layer 118 is cut away to indicate where the shelves 114 should be placed. In some embodiments, the notches are of the height of the shelf 114 such that when the shelf 114 is in the proper place the notch is not visible in the assembled temporary display rack 100.

With reference to FIG. 1B, in some embodiments, the graphics layer 118 that is affixed to an interior surface of the side panel 106 (or the interior surface of a respective vertical panel 208 of the folded frame 122) includes removable perforated coverings 126 that can be removed to reveal the receiving slots 402. In some embodiments, at least a portion of removable perforated coverings 126 are removed before shipping the display unit 120. For example, in order to enable retailers using the display unit 120 to hold product of a pre-determined height, removable perforated coverings are removed before shipment so that shelf height will be sufficient to hold the product of the pre-determined height (e.g., so that each of the shelves is configured to have a sufficient height to hold soda cans).

In some embodiments, the shelf placement indication 416 is printed in a different color or printed with instructional arrows or similar indicators of where the shelves 114 should be placed. As illustrated in FIG. 4, in some embodiments, the bottom surface 404 and any tabs 420 extending therefrom are not affixed with graphics.

In some embodiments, the side panel 106 (or a respective vertical panel 208 of display unit 120) includes at least one display code 418. The display code 418 is typically a unique scannable display code used for retail activation. For instance, in some embodiments, it is a program-specific universal product code ("UPC"). Although FIG. 4 illustrates the display code 418 located on the second side panel 106, in other embodiments, the display code 418 is provided on a different portion of the chassis 102, such as the first panel 104 or the back panel 108. In some embodiments, as illustrated in FIG. 4, the display code 418 is placed on the interior surface 412 of the side panel. In some embodiments, the code is placed in a location that is not visible until the flat kit 200 has been removed from its shipping container and has been at least partially assembled. By ensuring that the display code is not visible until the temporary display rack is at least partially assembled, the retailer (e.g., the retailer supplying the temporary display rack and coordinating the corresponding merchandising campaign) is assured that scanning of the display code 418 more reliably indicates that the merchant is in compliance with the merchandising campaign.

In some embodiments, the display code 418 is included in the graphics affixed to the side panel 106 (or a respective vertical panel 208 of display unit 120). In other embodiments it is separately affixed to the side panel 106 or to the graphics on the side panel 106 (e.g., via separate sticker.) In some embodiments, the unique scannable display code 418 provides information regarding a marketing campaign associated with one or more products that are to be placed on the temporary display rack. In some embodiments, when scanned, the display code 418 provides information regarding campaign activation to an entity (e.g., a retailer) distinct from a merchant in possession of the temporary display rack. For instance, after scanning, information may be communicated to the manufacturer, to the CPG, or to the entity that produced and/or delivered the temporary display rack to the merchant. Thus, these external entities are notified that the program has started or is being executed by the merchant. One of the benefits of the display code 418 is that the retailer can gain visibility into specific store execution. Furthermore, the retailer receives proof of merchandising compliance. Generally, compliance improves merchandising success, which results in increased product sales. Also, with proof of execution, the CPG can assist with in-store labor associated with setting up and stocking the display, which results in decreased labor costs to the merchant. Furthermore, when the display code 418 is scanned, the CPG has evidence of the merchandising display being activated, which allows for a more predictable return on investment (ROI). Furthermore, the company that produces and/or delivers the temporary display rack also receives access to store-level execution information, which allows the company to generate service fees to manage the CPG's costs and labor credits.

In some embodiments, the temporary display rack includes either or both of a base with wheels or a pallet base. Turning now to FIGS. 5A-5B, an example base with wheels 110 (FIG. 5A) and an example pallet base 124 (FIG. 5B) are each shown. The base 110, or the pallet base 124, is configured to support everything above it, e.g., the disposable chassis 102, shelves 114, and any product(s) displayed thereon. In some embodiments, the base 110 is a re-usable base 110. For instance, in some embodiments, the re-usable base 110, or the pallet base 124, is made of wood or plastic/polymer. In some embodiments, the base 110 is molded from a suitable polymer, such as nylon 6/6 or high-impact polystyrene, preferably in one piece or alternatively in plural pieces welded or joined adhesively, via rivets, or via other fasteners. As such, typically a re-usable base 110 is shipped to a merchant along with the chassis components and shelves in a first flat kit 200 as a part of a first marketing campaign. Then the re-usable base 110 is used, for subsequent marketing campaigns (or for a new phase of a current marketing campaign), with additional flat kits 200 (e.g., flat kits that are distinct from the first flat kit) that are shipped without a new base. In some embodiments, the additional flat kits 200 include new display graphics or new items codes to apply to the temporary display rack. In these embodiments, the new display graphics or new item codes provide updated instructions for product arrangement on the temporary display rack. In other embodiments, each additional flat kit includes one or more of: a new first side panel, a new second side panel, a new back panel, a new header piece, new display graphics, and/or new item codes. In this way, the specific store in which the temporary display rack is located can quickly and easily re-assemble or re-configure the temporary display rack.

In some embodiments, the re-usable base 110 further includes a plurality of wheels 112. Typically, one wheel 112, or one set of wheels 112, is mounted under each corner of the base 110, as shown in FIG. 5A. In some embodiments, the wheels 112 are multi-directional such that they facilitate movement of the temporary display rack 100 (even when loaded with product) in any direction along the floor. In some embodiments, the wheels 112 or wheel sets 112 are each mounted on a swivel caster rotatable about an axis substantially perpendicular to the floor upon which the wheels rest. Typically, the wheels 112 are mounted to the rotatable caster via an axle pin so as to be freely rotatable about a generally horizontal axis defined by the axle pin. The entire wheel assembly is secured to the base 110 via rivets, other fasteners, or adhesively. In some embodiments, each wheel 112 is molded from a suitable polymer, such as nylon 6/6 or high-impact polystyrene, preferably in one piece or alternatively in two halves welded or joined adhesively. In some embodiments, steel pins or other fasteners are used for the axle pins.

In some embodiments, the base 110 also includes one or more receiving slots 502 substantially sized to snugly receive a tab 420 of a component of the chassis 102 (e.g., the first side panel 104, the second side panel 106, or the back panel 108). For instance, when the chassis components are made of honeycomb cardboard having a thickness of ¾ of an inch and tabs 420 integrally formed thereon, then the receiving slots 502 of the base 110 will also have a thickness of ¾ of an inch. In some embodiments, the pallet base 124 includes a slot-creating insert 504 that, when inserted into the pallet base 124, leaves sufficient space to receive the tabs 420 (e.g., tabs 420 of the first side panel 104, FIG. 2A, or tabs 420 of a respective vertical panel 208 of the foldable frame 122, FIG. 2B).

As shown in FIG. 5A, in some embodiments, the base 110 is equipped with four wheels 112. The base 110 is arranged to elevate the temporary display rack 100 above a floor by a few inches so as to reduce structural integrity damage due to water wicking from the lower edges of the temporary display rack 100, cleaning appliances striking the temporary display rack 100, or both. The wheels 112 are designed to resist accidental movement of the temporary display rack 100, as along the floor, but to facilitate manual pushing, pulling, or turning movement of the temporary display rack 100 along the floor.

Figure 7A:
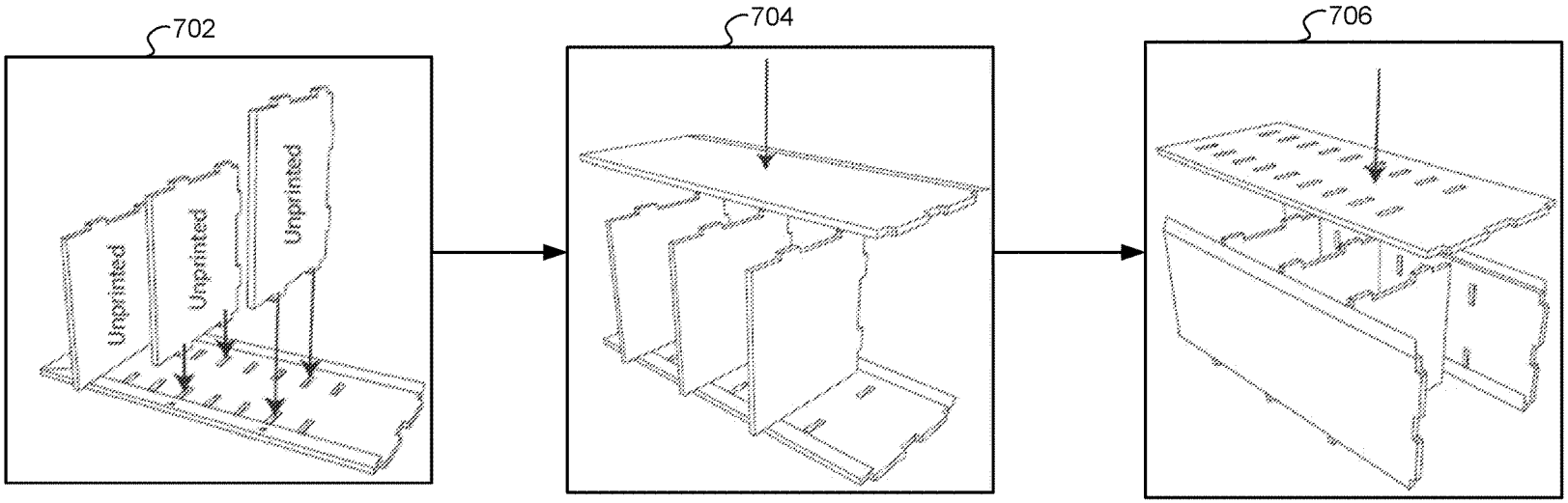
FIGS. 7A and 7B include illustrations and instructions for a method of assembling a flat kit into a temporary display rack, in accordance with some embodiments.
Figure 7B:
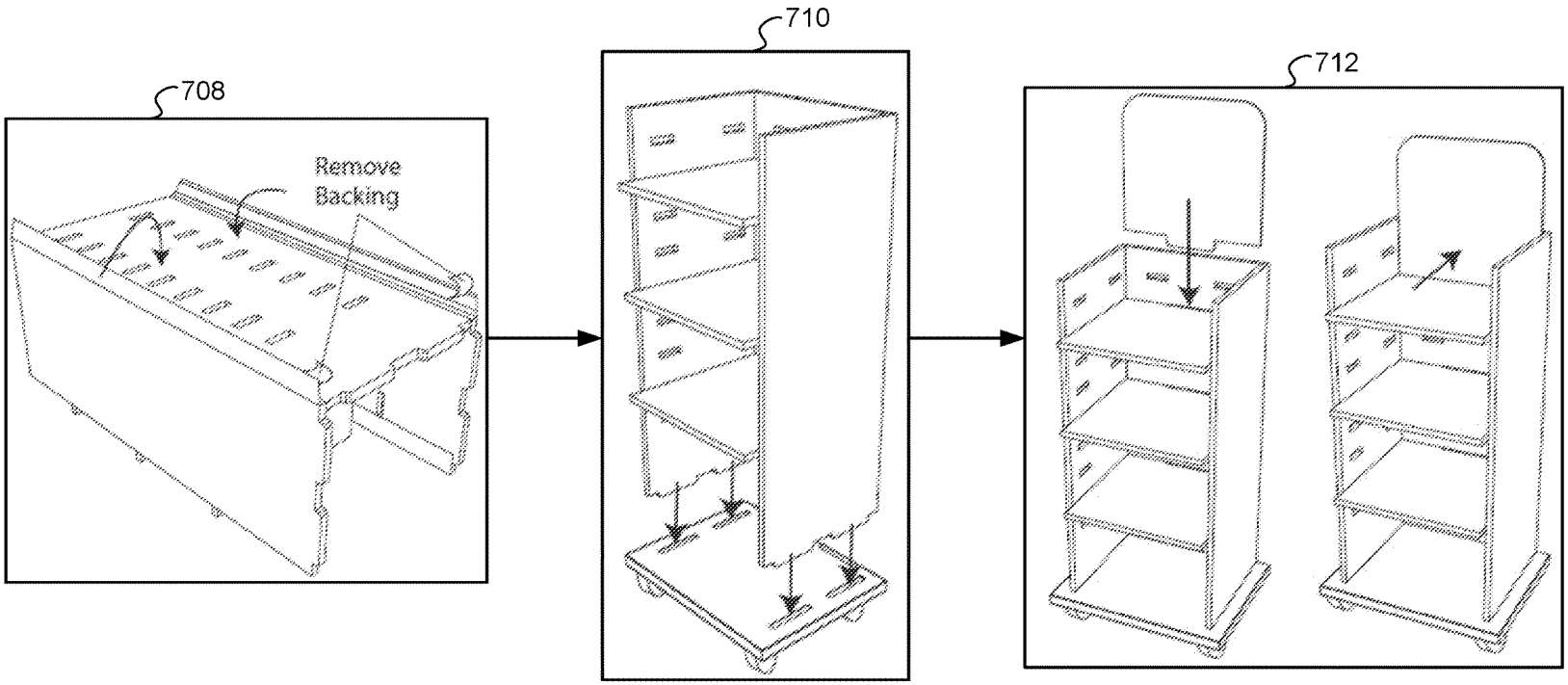

FIG. 6 is an exploded view of a flat kit 200 (e.g., a first flat kit or an additional flat kit that includes one or more of the components of the flat kit 200) for a temporary display rack 100, in which one or more of the disassembled components of the temporary display rack 100 are stacked together and inserted into a shipping box 602, in accordance with some embodiments. The flat kit 200 is foldable such that it can be shipped in a flat configuration. The flat kit 200 includes a chassis 102 including a first side panel 104, a back panel 108, and a second side panel 106. In some embodiments, the chassis 102 is a hinged chassis 202, which also includes a first hinge apparatus connecting the first side panel 104 to the back panel 108 such that a planar surface of the first side panel 104 at least partially overlaps and contacts a planar surface of the back panel in a folded position. In some embodiments, the hinged chassis 202 further includes a second hinge apparatus connecting the second side panel 106 to the back panel 108 such that a planar surface of the second side panel at least partially overlaps and contacts a planar surface of the first side panel in a folded position. In other embodiments, the first and second hinges are not connected to the components of the chassis 102 during shipment, or are connected to only one chassis component and are then connected to the other component(s) during assembly as illustrated in FIGS. 7A-7B either adhesively, with hook and loop fasteners, or with other suitable attachment mechanisms. As discussed about in reference to FIG. 2B, in some embodiments, the flat kit 200 instead includes a pre-adhered foldable frame 122 with a plurality of vertical panels 208 joined by vertical fold lines 210.

In some embodiments, the flat kit 200 also includes a plurality of shelves 114 configured to be supported by the chassis 102 when unfolded and assembled. When the first and second side panels (e.g., first side panel 104 and second side panel 106) are in their respective folded and/or stacked positions, the chassis 102/202 is configured to be transportable along with the plurality of shelves 114 as a flat kit 200 for subsequent assembly into a temporary display rack 100. In some embodiments, the flat kit 200 also includes a header piece 116 used to display images, information, or advertising. As illustrated in FIG. 6, the header piece 116 is typically thinner than the other components, thus making it light and easy to ship. For instance, in some embodiments, during the approximately three month life of a typical marketing campaign (or of a particular seasonal phase of an on-going marketing campaign) using the temporary display rack 100, a new header piece (and/or new display graphics) is shipped each month to update the campaign for a current season or marketing campaign focus. The header piece 116 is typically also disposable and made of recyclable materials. In some embodiments, the header piece 116 may be made of corrugated cardboard covered on both sides with a graphic display layer 118. Typically, the header piece includes one or more tabs 604 configured to slide between a top shelf 114 and the back panel 108 of the assembled temporary display rack 100. In some embodiments, the header piece 116 includes, on its back side, a removable twin stick back or hook-and-loop fasteners which secure the header 116 to the back panel 108 during assembly. Although not illustrated in FIG. 6, in some embodiments, the flat kit 200 also includes a re-usable base 110 configured to support the temporary display rack when assembled.

FIGS. 7A and 7B include illustrations and instructions for a method of assembling a flat kit 200 into a temporary display rack 100 in accordance with some embodiments. In some embodiments and as explained in more detail below in reference to FIGS. 12A-12D and 13A-13B, no components of the temporary display rack need to be glued or adhered together during assembly (thus decreasing time required for unpacking and preparing a temporary display rack for use at a retailer).

As illustrated in FIG. 7A, in the first illustrated step (702), the second side panel 106 is laid down so that its printed side faces the floor. It is noted that in some embodiments, the side panels 104/106 can be distinguished from the back panel 108 because they are narrower than the back panel 108. Then, in some embodiments, one or more adjustable shelves 114 are inserted into the second panel 106. When a shelf 114 is only covered with a graphic display layer 118 on one side, then the unprinted side of the shelf faces toward the tabs 420 on the bottom side of the second side panel 106. In some embodiments, the adjustable shelves 114 are inserted into the second side panel 106 according to shelf placement indications 416.

In the second illustrated step (704), the first side panel 104 is placed onto the tabs 302 of the shelves 114 so that the tabs 302 are received snugly into the corresponding receiving slots 402 in the first panel 104. In some embodiments, in order to make sure that the shelves will be substantially horizontal to the floor when upright, the user should also check that the shelves are inserted into the first side panel 104 in accordance with the shelf placement indications 416.

In the third illustrated step (706), the semi-assembled temporary display rack is turned so that its front faces the floor. Then the back panel 108 is placed onto the tabs 302 of the shelves 114 so that the tabs 302 are received snugly into the corresponding receiving slots 402 in the back panel 108.

The method continues in FIG. 7B. In the fourth illustrated step (708), the first side panel 104 and the second side panel 106 both include a pre-assembled hinge apparatus, each having a flap with a removable backing that protects an adhesive material. In this step, the first backing is removed from the first flap. The first side panel 104 is connected to the back panel 108 via the first adhesive material of the first hinge 204*a*. Likewise, the second backing is removed from the second flap. The second side panel 106 is connected to the back panel 108 via the second adhesive material of the second hinge 204*b*. The first and second adhesive materials are pressed down firmly onto the back panel 108 to ensure that the adhesives are secure. One benefit of assembling the shelves 114 inside the chassis 102 (comprising the first side panel 104, the second side panel 106, and the back panel 108 in this embodiment) is that the first and second hinges 204 are adhered (either permanently or removably) to the back panel 108 in its assembled configuration, allowing the hinges 204 to make a tight and secure corner for the assembled temporary display rack 100.

In the fifth illustrated step (710), an optional base 110 having wheels 112 is provided. The bottom tabs 420 of the chassis (comprising bottom tabs 420 from the first side panel 104, the second side panel 106, and the back panel 108 in this embodiment) are each inserted so that the bottom tabs 420 are received snugly into the corresponding receiving slots 502 in the base 110. In some embodiments, the bottom tabs 420 are of substantially the same width as the tabs 302 and the bottom tabs 420 are longer than the tabs 302.

In the sixth illustrated step (712), an optional header 116 is provided. The header 116 is inserted into a slot at the back edge of the top shelf 114, between the top shelf 114 and the back panel 108. Then, in some embodiments, twin-stick backing is removed from the back side of the header and pressed onto the back panel 108 to secure the header 116. Finally, the assembled temporary display rack 100 is loaded with one or more types of product onto its shelves 114 and the temporary display rack may be moved into its display position.

Figure 8:
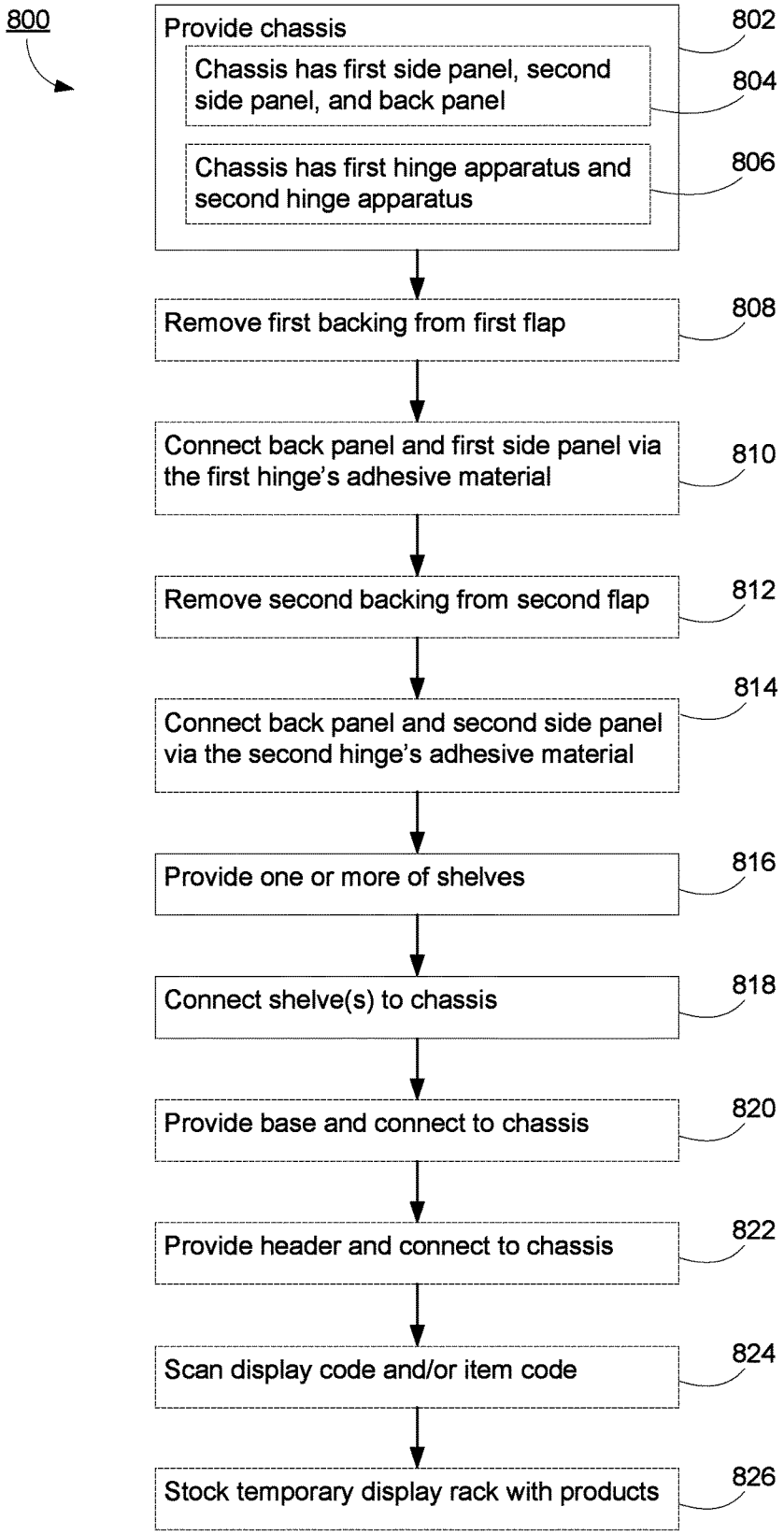
FIG. 8 is a flowchart representing a method of assembling a flat kit into a temporary display rack, in accordance with some embodiments.

FIG. 8 is a flowchart representing a method of assembling 800 a flat kit 200 into a temporary display rack 100, in accordance with some embodiments.

First, a chassis is provided (802). In some embodiments, the chassis includes a first side panel, a back panel, and a second side panel (804). In some embodiments, the first side panel includes a first plurality of slots, the second side panel includes a second plurality of slots, and the back panel includes a third plurality of slots. In some embodiments, the first, second, and third pluralities of slots each contain the same number of slots. For example, the first, second, and third pluralities of slots are arranged in nine rows and two columns, such that each row includes two slots each, for a total of eighteen slots. In some embodiments, the first plurality of slots and the second plurality of slots are in substantially the same x-y positions (i.e., each slot on the first side panel has the same Cartesian coordinates as a corresponding slot on the second side panel) on the first and second side panels, respectively. Stated another way, in some embodiments, the first and second pluralities of slots are mirror images of one another.

In some embodiments, the chassis also includes a first hinge apparatus and a second hinge apparatus (806). In some embodiments, the first hinge apparatus is attached to the first side panel and includes a first flap having first adhesive material covered with a first removable backing. Similarly, in some embodiments, the second hinge apparatus is attached to the second side panel and includes a second flap having second adhesive material covered with a second removable backing. In other embodiments, the first and second hinge apparatuses are both attached to the back panel.

In some embodiments, the first backing is removed from the first flap (808). Then the first side panel is connected to the back panel via the first adhesive material of the first hinge (810). In some embodiments, the second backing is removed from the second flap (812). The second side panel is connected to the back panel via the second adhesive material of the second hinge (814). As such, a chassis is formed from the first side panel, the back panel, and the second side panel connected to one another via the first and second hinge apparatuses. In other embodiments the first and second hinge apparatuses are already attached to the side panels and the back panel such that the chassis is erected simply by unfolding the side panels from the back panel (in these other embodiments, the flat kit used to ship the components of the temporary display rack included first and second hinges that were already attached to the side panels). In still other embodiments, the hinges are not attached to either of the side panels or the back panels. In these embodiments, the hinges are attached to the temporary display rack after the chassis components are secured to the shelves (e.g., the hinges are a standalone component that is used to secure or couple the side panels to/with the back panel).

One or more shelves are also provided (816). Each shelf of the one or more shelves is connected to the chassis (818). Typically, a respective shelf is connected to the chassis by inserting a tab on the shelf into a corresponding slot in one or more of the side or back panels of the chassis. It is noted that in some embodiments, the one or more shelves are inserted into the components of the chassis (e.g., the two side panels and/or the back panel).

In some embodiments, a base (which may be re-useable and may have wheels) is also provided, and the chassis is inserted into (i.e., connected to) the base, via similar tabs and slots to the mechanism used to inset the shelves into the chassis (820). In some embodiments, the tabs and slots used to connect the base to the chassis are larger than (e.g., are of substantially the same width, but are longer than) the tabs and slots used to insert the shelves into the chassis. In some embodiments, the base includes a fourth plurality of slots (e.g., the third plurality contains a number of slots that is distinct from the number of slots contained in the first, second, and third pluralities of slots). In some embodiments, each slot of the fourth plurality of slots is configured to receive one of the tabs of the first side panel, the second side panel, or the back panel. In some embodiments, the slots in the fourth plurality of slots have at least one dimension that differs from the dimensions of the slots in the first, second, and third pluralities of slots (e.g., the slots in the fourth plurality of slots are longer (have substantially the same width and also have a larger length dimension)).

In some embodiments, a header piece is also provided, and is connected to the chassis (822). Typically, connecting the header to the chassis is accomplished by inserting one or more tabs of the header between a top shelf and the back panel of the assembled temporary display rack 100. In some embodiments, the header piece is also affixed to the back panel by a removable twin-stick back on its back side or by hook and loop or other suitable fasteners. In some embodiments, the assembly of the display rack is completed in less than two minutes.

After assembly, the display code is scanned for retail activation and the item code(s) are scanned (824). In some embodiments, scanning the display code causes information regarding a marketing campaign associated with one or more products that are to be placed on the temporary display rack to be transmitted to the manufacturer, to the CPG, or to the entity that produced and/or delivered the temporary display rack to the merchant (as discussed in more detail above). In some embodiments, scanning the item code(s) allows the merchant to create and print a price label for the shelf and/or for each product.

Finally, the display rack is stocked with appropriate products (826). For instance, the product(s) associated with the item code(s) are placed on and/or behind the item codes or are placed according to a planogram associated with the item code(s). Finally, the temporary display rack is placed in the merchant's display room. For instance, in some embodiments, it may be moved into position using the wheels on the base.

Figure 9:
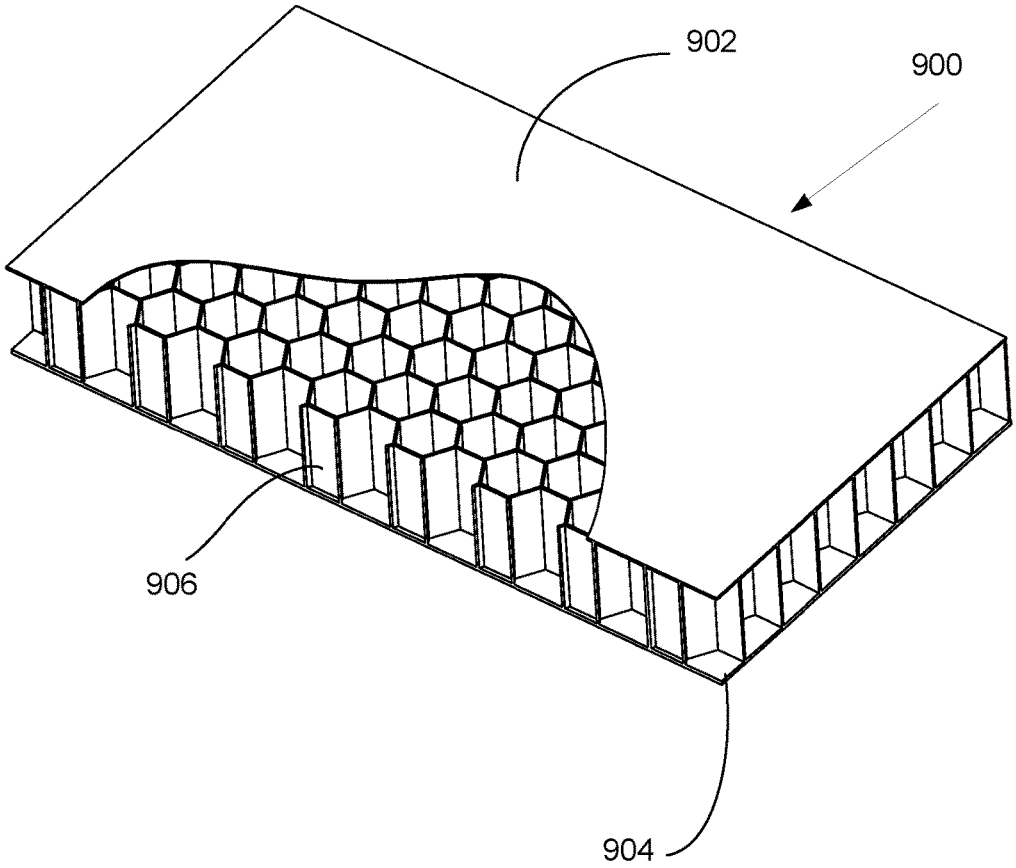
FIG. 9 is a perspective detailed view of a honeycomb material used to make the panels and shelves of the temporary display rack, in accordance with some embodiments.

FIG. 9 is a perspective detailed view of a honeycomb material 900 used to make the panels (e.g., side panels 104 and 106 and back panel 108, or each respective vertical panel 208) and shelves 114 of the temporary display rack 100 (or the display unit 120), in accordance with some embodiments. In some embodiments, the honeycomb material 900 is disposable. For instance, in some embodiments, it is made of recyclable fiber-based materials. Thus, these components can be recycled by using existing fiber recycling supply chains at retailers or by using a vendor's internal supply chains. In some embodiments, the honeycomb cardboard material 900 components are each approximately ¾ of an inch thick, as opposed to more traditional corrugated cardboard which is typically approximately ⅛ of an inch thick. In some embodiments, the components are made of a honeycomb cardboard 900 material having a thickness of at least half an inch. In some embodiments, the honeycomb cardboard 900 consists of a top layer 902, a bottom layer 904, and a honeycomb shaped internal layer 906, wherein each honeycomb cell has a hexagonal cross section. This honeycomb material 900 allows the components of the temporary display rack 100 to be stronger and lighter than a corresponding corrugated cardboard component. For instance, in some embodiments, each shelf 114 of the disclosed design is capable of supporting 45 lbs. In other embodiments each shelf 114 of the disclosed design is 1 inch thick and is capable of supporting 60 lbs., 65 lbs., 70 lbs., 75, lbs. or even up to 100 lbs. Additionally, the honeycomb cardboard that is capable of supporting up to 100 lbs. weighs approximately 30% less than a corresponding corrugated cardboard component. As such, the components are not only cheaper to ship, but are also easier to recycle and even require less paper for their initial construction, which consequently leaves a smaller carbon footprint.

FIG. 10 is a perspective view of an example foldable frame 122 comprising a plurality of vertical panels 208 joined at vertical fold lines 210, in accordance with some embodiments. As shown in FIG. 10, the example foldable frame 122 is in the process of being folding into a substantially flat-folded position (e.g., a first configuration of the foldable frame that allows for inclusion of the foldable frame 122 in a flat kit for shipment to a retailer). The display graphics 118 include perforated coverings 126 that overlay, obscure, conceal, or otherwise hide the receiving slots 402. Some of the removable perforated coverings 126 can be removed prior to shipment of the display unit 120, to align the height of the plurality of shelves 114 with specifications for a product to be loaded on each of the shelves.

FIG. 11 is a perspective view of an example foldable frame 122 comprising a plurality of vertical panels 208 joined at vertical fold lines 210 in the process of being folded into a substantially rigid-angled position (e.g., a second configuration of the foldable frame) with supporting shelves 114 inserted there between, in accordance with some embodiments. In some embodiments, the substantially rigid-angled position can also be described as a simple open convex polygon and the planar surfaces of the vertical panels do not contact each other. In some embodiments, the substantially rigid-angled position is also referred to as a substantially right-angled position when the foldable frame is assembled and the shelves are fully inserted into the side panels 208-1, 208-3 and back panel 208-2. In some embodiments, the shelves 114 each include lips 130 (e.g., lip 130-1 for a first shelf 114, lip 130-2 for a second shelf 114, and lip 130-3 for a third shelf). Lips 130 are discussed in more detail above (e.g., in reference to FIG. 1C). In other embodiments, the shelves 114 do not include lips (e.g., as shown in FIG. 1B). In some embodiments, lips are included if the product to be stocked on a respective shelf is breakable and, thus, the inclusion of a lip helps to ensure that breakable product does not fall off of a shelf. Additional information regarding assembly of the foldable frame is provided below in reference to FIGS. 13A-13B.

FIGS. 12A-12D include illustrations and instructions for a method 1200 of packing a flat kit for shipment to a retailer, in accordance with some embodiments. FIGS. 1A-1C, and 5B are used to illustrate various aspects of the display unit that are pertinent to the methods and/or processes of FIGS. 12A-12D. In some embodiments, the method 1200 is performed by an employee at a shipping location for a manufacturer or designer of the display unit (e.g., a print procurement company that designs the display unit and provides the display unit to suppliers, retailers, and/or merchants). For ease of explanation, the following describes method 1200 as performed by such an employee. Some operations in method 1200 are, optionally, combined and/or the order of some operations is, optionally, changed.

Figure 12A:
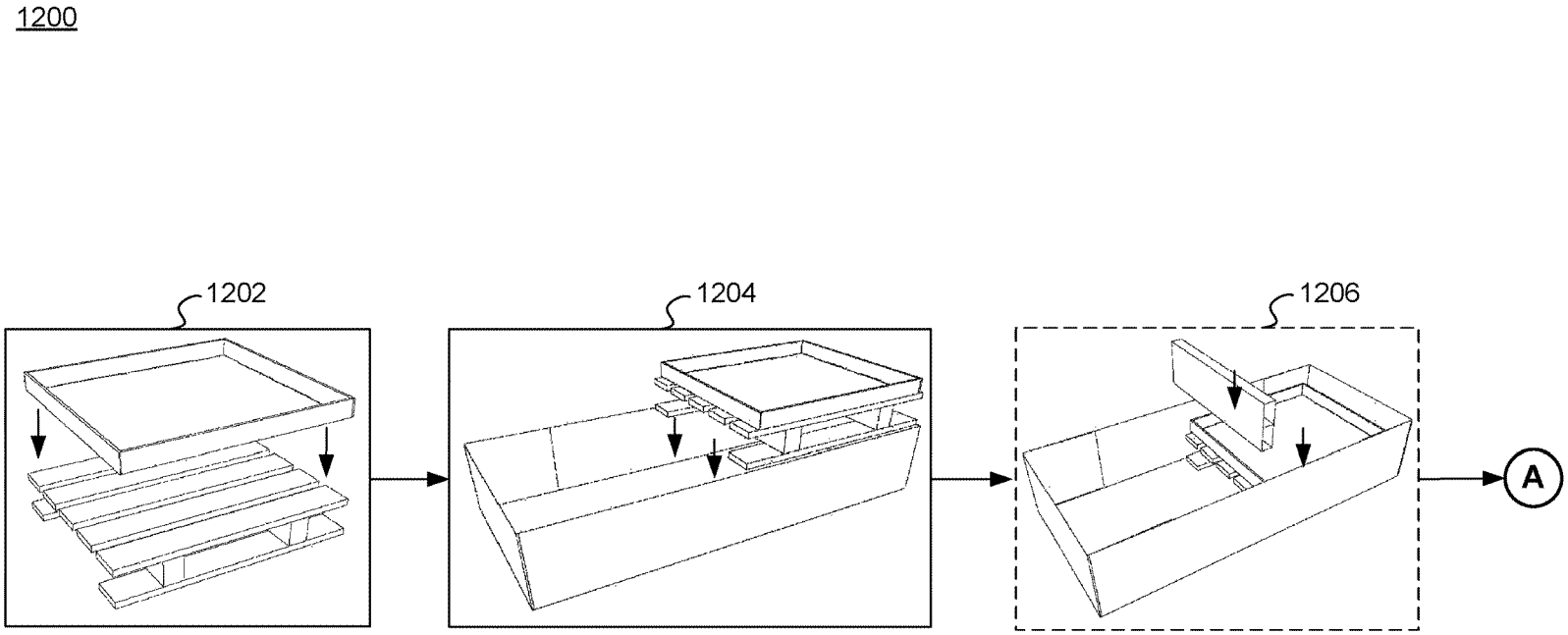
FIGS. 12A-12D include illustrations of a method in which components of the display unit are packed as a flat kit in a shipping box, in accordance with some embodiments.

As illustrated in FIG. 12A, in the first step (1202), the pallet base 124 is assembled by attaching (e.g., stapling) a rectangular cardboard component on top of a wooden portion of the pallet base. In some embodiments, the rectangular cardboard component includes a slot-creating insert (e.g., insert 504, FIG. 5B) that has one or more receiving slots that are configured to receive one or more tabs of the foldable frame (thereby securing the foldable frame to the pallet base). In the next illustrated step (1204), the pallet base 124 is placed inside of a shipping box (e.g., shipping box 602, FIG. 6). Then, optional step 1206 shows a first protective insert being placed alongside the pallet base 124 within the shipping box. In some embodiments, the first protective insert is used to help prevent damage to other components that are contained within the flat kit 200 and could be damaged by the pallet base 124 during shipping.

Figure 12B:
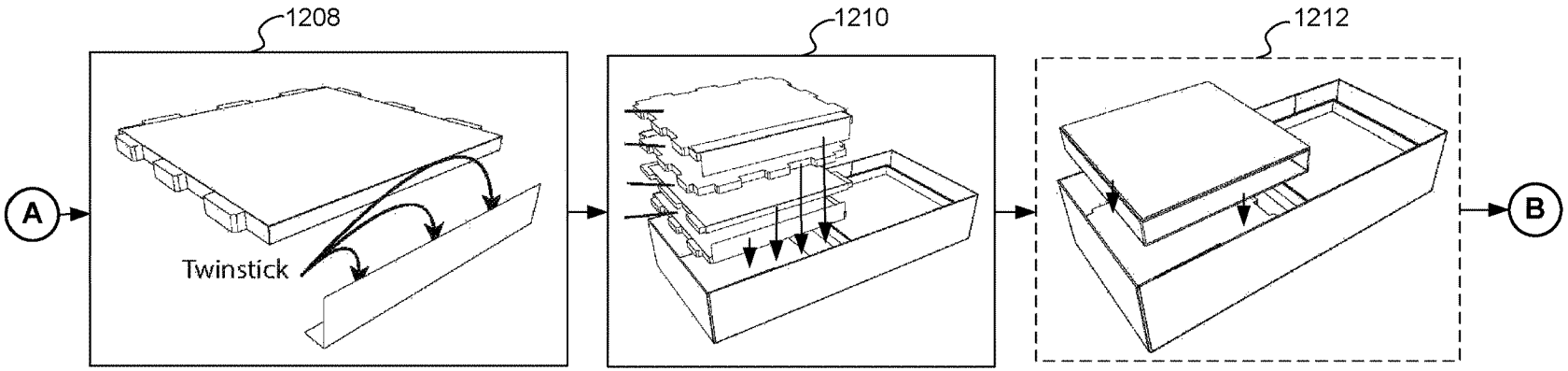

Turning now to FIG. 12B, the method 1200 further includes providing a plurality of shelves (e.g., shelves 114, FIGS. 1B and 1C). Each of the plurality of shelves is attached to a respective lip (e.g., lips 130, FIG. 1C) with an appropriate adhesive (e.g., twin stick), as shown in step 1208. In this way, a retailer receiving the flat pack with the components of the display unit does not need to assemble the shelves and lips, instead they are pre-assembled.

In the next illustrated step (1210) the shelves are placed in the shipping box next to the first protective insert. In some embodiments, the shelves are stacked before insertion into the shipping box, so that a protruding portion of each of the attached lips is facing in a downward direction relative to the stack of shelves (1210) and, in this way, the attached lips are protected from damage during shipment. In some embodiments, the slot-creating insert is also included with the stack of shelves.

The method also optionally includes placing (1212) a second protective insert into the shipping box (distinct from the first protective insert) and on top of the stack of shelves. When a second protective insert is used it can ensure that the stack of shelves and the slot-creating insert fit snugly in the shipping box 602 and next to the pallet base 124. The second protective insert can also fill the shipping box to the same height as the pallet base 124, leaving a substantially level surface for placement of other components of the flat kit 200 within the shipping box.

Figure 12C:
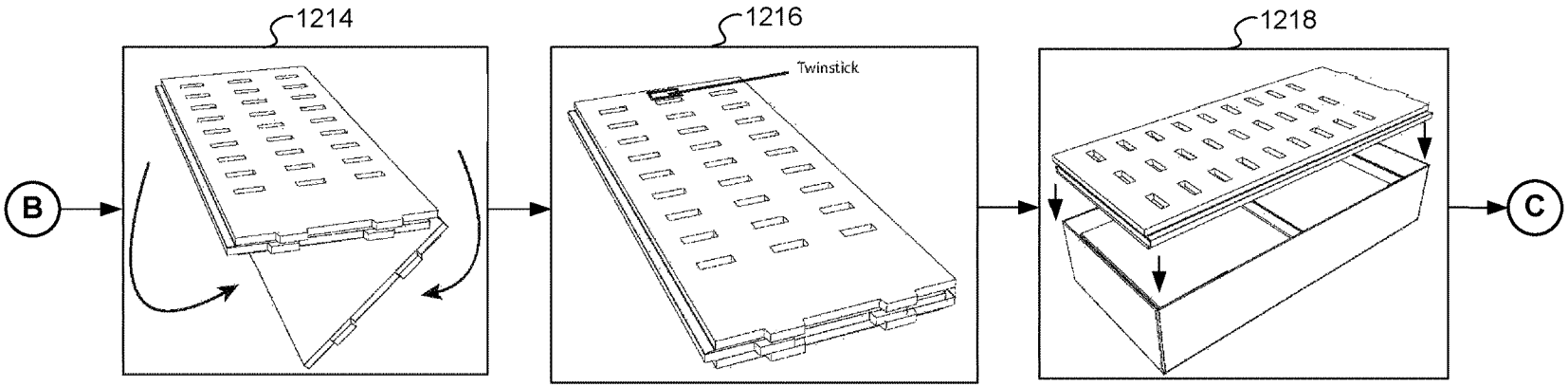

As illustrated in FIG. 12C, some embodiments of the flat kit 200 include a foldable frame 122. The method also includes folding (1214) the foldable frame 122 along vertical fold lines (e.g., vertical fold lines 210-1 and 210-2, FIG. 2B) into a substantially flat-folded position by folding side panels (e.g., side panels 104 and 106, FIG. 2A, or side panels 208-1 and 208-3, FIG. 2B) along a respective vertical fold line such that a substantially planar surface of each side panel at least partially overlaps and contacts a substantially planar surface of an adjacent panel.

In some embodiments, a piece of twin stick is applied (1216) to the foldable frame 122 while it is folded in the substantially flat-folded position. In some embodiments, the piece of twin stick allows for later attachment of a header piece to the display unit (as described above, e.g., in reference to FIGS. 1A-1C). The method further includes, inserting (1218) the foldable frame into the shipping box 602 along with (e.g., on top of) the other components of the flat kit 200. One important advantage of the foldable frame 122 is that the vertical fold lines 210 allow for speedy assembly at the retailer, because the foldable frame is pre-assembled (i.e., each respective vertical panel 208 is pre-adhered to adjacent vertical panels) and thus it is easy to quickly remove the foldable frame in the substantially flat-folded position from the shipping box and quickly assemble the foldable frame into the substantially rigid-angled position. One further advantage of the substantially flat-folded position for shipment of the foldable frame is that exterior-facing surfaces of the vertical panels 208 are protected during shipment.

Figure 12D:
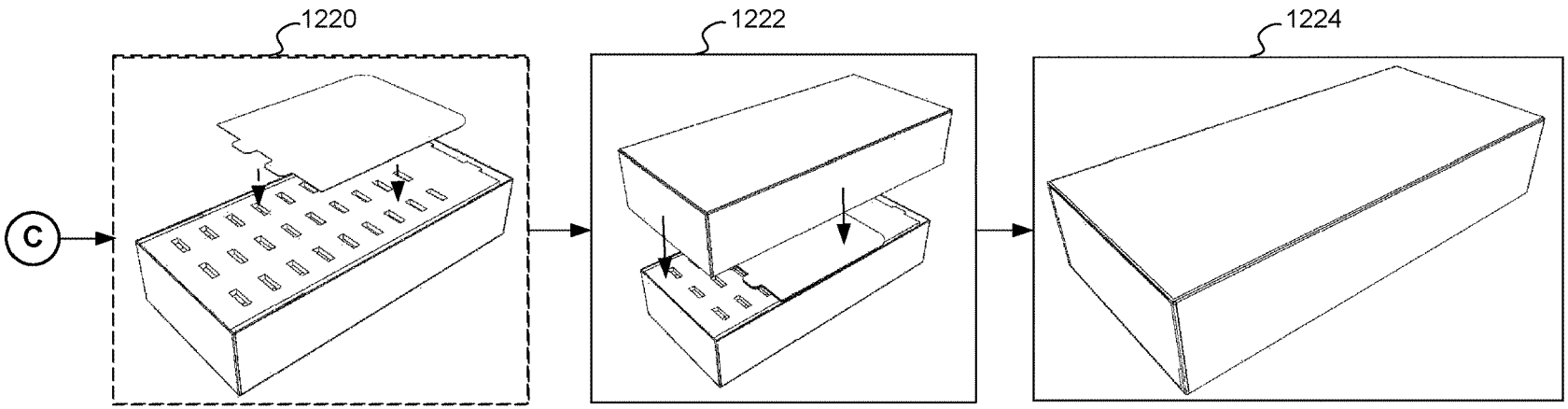

Turning now to FIG. 12D, the method optionally includes (for embodiments in which a header piece 116 is part of the flat kit 200) inserting (1220) the header piece 116 into the shipping box 602. The top of the shipping box 602 is then placed (1222) over the bottom of the shipping box 602 (in which the aforementioned components have already been packed). As shown in step 1224, the shipping box 602 is fully assembled (with the flat kit 200 included therein) and is ready for shipment.

Figure 13A:
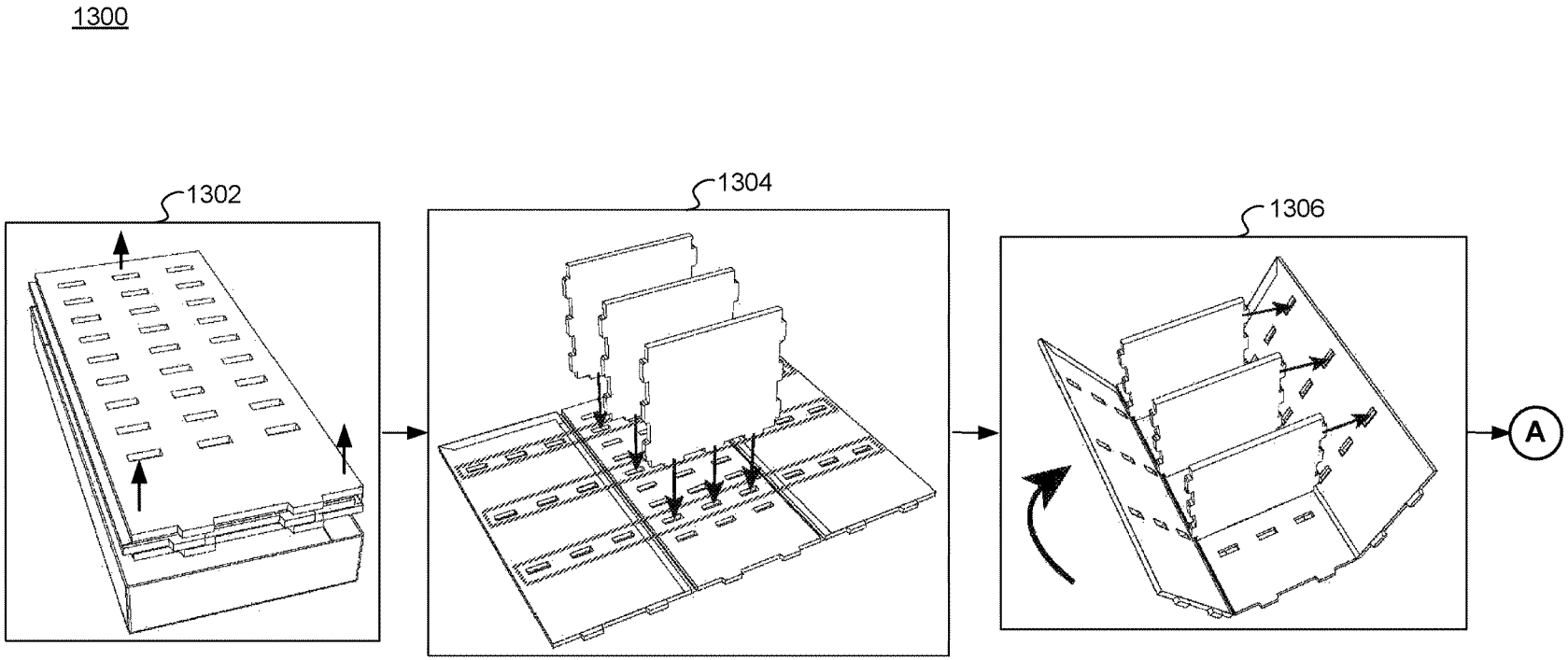
FIGS. 13A and 13B include illustrations of a method of assembling a display unit, in accordance with some embodiments.
Figure 13B:
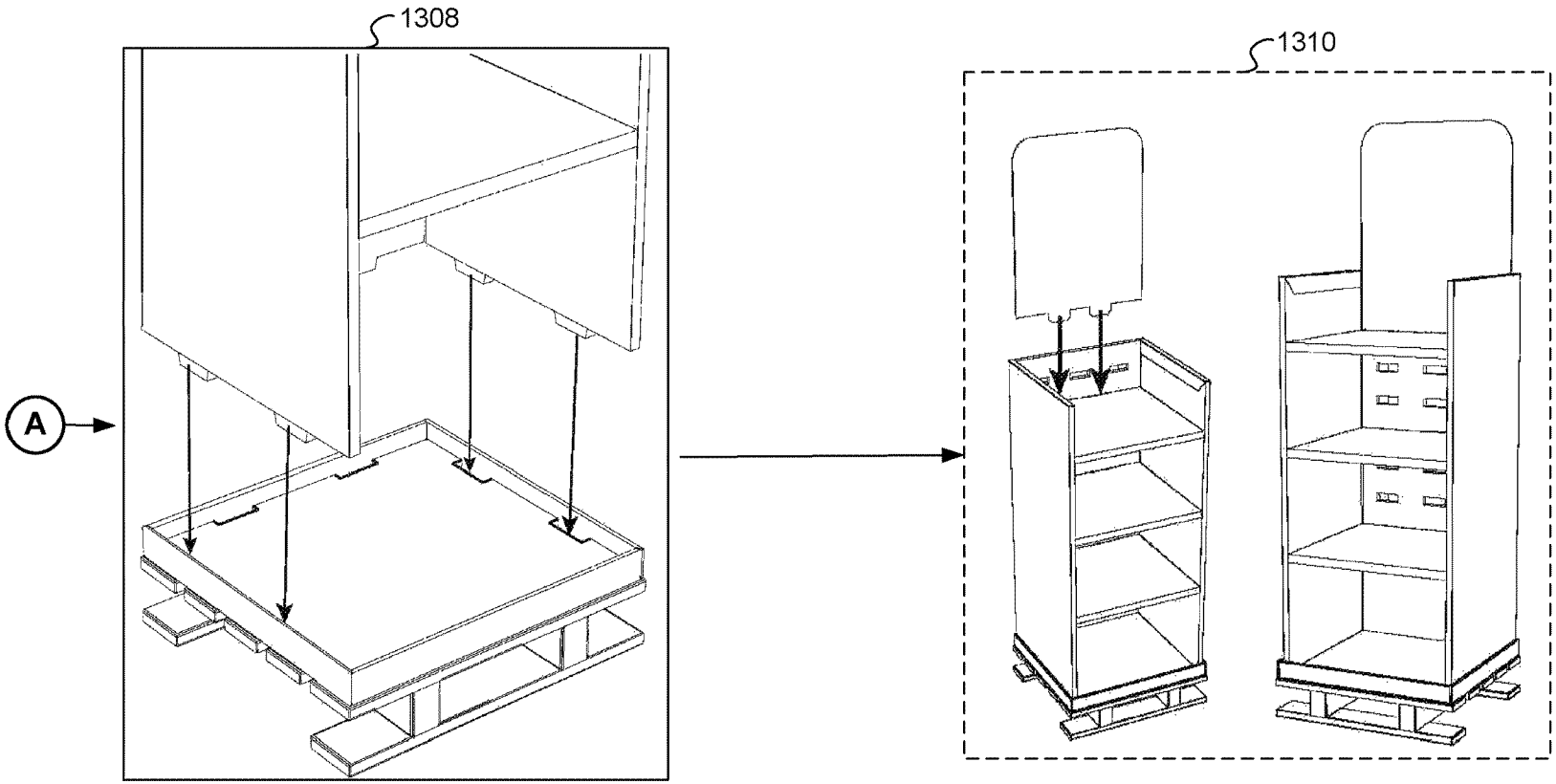

FIGS. 13A and 13B include illustrations and instructions for a method 1300 of assembling a flat kit 200 into a display unit 120, in accordance with some embodiments. FIGS. 1A-1C, and 5B are used to illustrate various aspects of the display unit that are pertinent to the methods and/or processes of FIGS. 13A and 13B. In some embodiments, the method 1300 is performed by an employee at a receiving location for a retailer (e.g., a grocery, clothing, outlet, or other retail establishment that has a need for displaying fungible goods). In some embodiments, the method 1300 is performed by the employee in less than one minute, as method 1300 does not require adherence of any tools (i.e., only the employee's hands are need during assembly) or any other component that is not included in the flat kit (i.e., because components are all pre-adhered, such as the foldable frame). In some embodiments, the employee performs the method 1300 using one or more instructional manuals provided by a manufacturer or designer of the display unit (e.g., a print procurement company that designs the display unit and provides the display unit to suppliers, retailers, and/or merchants). For ease of explanation, the following describes method 1300 as performed by the employee at the receiving location. Some operations in method 1300 are, optionally, combined and/or the order of some operations is, optionally, changed.

As illustrated in FIG. 13A, the method includes removing (1302) the foldable frame 122 from the shipping box 602. The method also includes: removing (1304) the plurality of shelves 114 from the shipping box and inserting tabs of each shelf into appropriate slots of one of the vertical panels (e.g., slots 402 of a back panel 208-2, FIG. 11) of the foldable frame 122. In some embodiments, the appropriate slots are pre-removed (e.g., perforated coatings 126 that previously covered each slot are removed before shipment of the display unit) in order to allow for quick assembly of the display unit at the receiving location.

In some embodiments, the method also includes: folding (1306) the foldable frame 122 into a substantially rigid-angled position, such that tabs of each shelf also fit into corresponding slots of the remaining vertical panels (i.e., side panels, because each shelf has already been inserted into the back panel). In some embodiments, each shelf is first inserted in receiving slots in the back panel 208-2 and, while folding the foldable frame in the substantially rigid-angled position, the shelves are then inserted into the remaining corresponding slots on the side panels (e.g., side panel 208-1 and 208-3).

Turning now to FIG. 13B, the method further includes: inserting (1308) the foldable frame in the substantially rigid-angled position into the pallet base 124 (e.g., the pallet base 124 includes the slot-creating insert 504, as discussed above in reference to FIG. 5B). In some embodiments, insertion of the foldable frame 122 into the pallet base 124 can only be successfully performed when the foldable frame 122 is in the substantially rigid-angled position. Stated another way, when the foldable frame is folded in the substantially rigid-angled position, each slot of the plurality of slots of the pallet base 124 is enabled to receive a respective tab of the one or more tabs of each vertical panel.

The method also optionally includes attaching (1310) a header piece 116 to the display unit 120 (e.g., by inserting a bottom portion of the header piece at the back of a topmost shelf and securing the header to the back panel using an adhesive (such as a piece of twin stick)).

The above description, for explanatory purposes, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. Various modifications may be made in the embodiments described above without departing from the scope and spirit of this invention. Thus, as an example, the temporary display rack equipped with the respective base and with the respective wheels may be generally of any size, shape, or style capable of displaying product in a retail environment.

What is claimed is:

1. A display unit comprising:

a foldable frame having a plurality of vertical panels joined at vertical fold lines, with display graphics and only one scannable display code for retail activation of the display unit, wherein the only one scannable display code is located on an interior surface of a respective vertical panel of the plurality of vertical panels; and at least one shelf, wherein the foldable frame is configured to support the at least one shelf, the at least one shelf having one or more item codes, distinct and separate from the only one scannable display code, that respectively identify one or more products to be placed on the at least one shelf.

2. The display unit of claim 1, wherein the foldable frame is configured to fold in two positions:

(i) a substantially flat-folded position in which a first and a second vertical panel of the plurality of vertical panels are each folded in a first direction along a respective vertical fold line; and (ii) a substantially rigid-angled position in which the foldable frame is supporting the at least one shelf and the first and the second vertical panel of the plurality of vertical panels are each folded in a second direction, along a respective vertical fold line.

3. The display unit of claim 2, wherein each vertical panel of the plurality of vertical panels includes one or more tabs and the display unit further includes a pallet base with a plurality of slots configured to receive the one or more tabs of each vertical panel of the plurality of vertical panels.

4. The display unit of claim 3, wherein, when the foldable frame is folded in the substantially rigid-angled position, each slot of the plurality of slots of the pallet base is enabled to receive a respective tab of the one or more tabs of each vertical panel.

5. The display unit of claim 3, wherein the plurality of slots of the pallet base is formed by a removable insert coupled with the pallet base.

6. The display unit of claim 5, wherein the at least one shelf, each vertical panel of the plurality of vertical panels, the pallet base, and the removable insert are configured to fit within a flat kit for shipment to a merchant.

7. The display unit of claim 1, wherein each vertical fold line of the vertical fold lines is formed by adhering the display graphics to a first vertical panel of the plurality of vertical panels and extending the display graphics onto a second vertical panel of the plurality of vertical panels.

8. The display unit of claim 7, wherein each vertical fold line of the vertical fold lines is formed before shipping the display unit to a merchant.

9. The display unit of claim 2, wherein the at least one shelf includes one or more tabs and each vertical panel of the plurality of vertical panels includes a plurality of slots, and further wherein when the foldable frame is folded in the substantially rigid-angled position, the at least one shelf is supported within the foldable frame by inserting each of the one or more tabs of the at least one shelf into a slot of the plurality of slots of the vertical panels.

10. The display unit of claim 9, wherein the display graphics include a plurality of removable perforated coatings that each cover a corresponding slot of the plurality of slots.

11. The display unit of claim 10, wherein at least three of the removable perforated coatings are removed from their corresponding slots of the plurality of slots of the vertical panels of the plurality of vertical panels prior to shipment of the display unit to a merchant.

12. The display unit of claim 1, wherein the at least one shelf includes:

a lip extending in a substantially perpendicular direction relative to a bottom surface of the at least one shelf.

13. The display unit of claim 12, wherein a first portion of the lip is attached to the bottom surface of the at least one shelf and bends, at a right-angle relative to the first portion of the lip, to form a second portion of the lip that extends above the bottom surface of the at least one shelf.

14. The display unit of claim 1, wherein the foldable frame and the at least one shelf are made of a recyclable cardboard material.

15. The display unit of claim 14, wherein the recyclable cardboard material is a honeycomb cardboard material having a thickness of at least half an inch.

16. The display unit of claim 15, wherein the at least one shelf that is made using the recyclable cardboard material is configured to support a load of at least 75 pounds.

17. The display unit of claim 1, wherein the display graphics include an indication as to where the at least one shelf should be placed.

18. The display unit of claim 1, wherein when scanned the only one scannable display code for retail activation is configured to provide information regarding campaign activation to an entity distinct from a merchant in possession of the display unit.

19. The display unit of claim 1, wherein the one or more products are placed on the at least one shelf in accordance with respective positions on the at least one shelf that are identified by the one or more item codes.

20. The display unit of claim 1, wherein the only one scannable display code, when scanned, indicates that a merchant is in compliance with a merchandising campaign associated with the display unit.

21. A method for assembling a display unit comprising:

providing a foldable frame that comprises (i) a plurality of vertical panels joined at vertical fold lines and (ii) only one scannable display code for retail activation of the display unit, wherein the only one scannable display code is located on an interior surface of a respective vertical panel of the plurality of vertical panels;

folding the foldable frame along each vertical fold line of the vertical fold lines, such that the foldable frame is in a substantially rigid-angled position; and in conjunction with folding the foldable frame, connecting at least one shelf to the foldable frame, such that the foldable frame while in the substantially rigid-angled position supports the at least one shelf, wherein the at least one shelf includes one or more item codes, distinct and separate from the only one scannable display code, that respectively identify one or more products to be placed on the at least one shelf.

22. A flat kit for a display unit comprising:

a foldable frame that comprises (i) a plurality of vertical panels joined at vertical fold lines and (ii) only one scannable display code for retail activation, wherein the only one scannable display code is located on an interior surface of a respective vertical panel of the plurality of vertical panels;

at least one shelf configured to be supported by the foldable frame when the foldable frame is folded in a substantially rigid-angled position, the at least one shelf having one or more item codes, distinct and separate from the only one scannable display code, that respectively identify one or more products to be placed on the at least one shelf;

wherein the foldable frame is folded into the substantially flat-folded position for inclusion in the flat kit, such that a substantially planar surface of a first vertical panel of the plurality of vertical panels at least partially overlaps and contacts a substantially planar surface of a second vertical panel of the plurality of vertical panels; and wherein the foldable frame is configured to be transportable while in the substantially flat-folded position along with the at least one shelf as the flat kit for subsequent assembly into the display unit.

* * * * *